US011361775B2

(12) United States Patent
Shlomot et al.

(10) Patent No.: US 11,361,775 B2
(45) Date of Patent: Jun. 14, 2022

(54) METHOD AND APPARATUS FOR RECONSTRUCTING SIGNAL DURING STEREO SIGNAL ENCODING

(71) Applicant: HUAWEI TECHNOLOGIES CO., LTD., Guangdong (CN)

(72) Inventors: Eyal Shlomot, Long Beach, CA (US); Haiting Li, Beijing (CN); Zexin Liu, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 316 days.

(21) Appl. No.: 16/797,446

(22) Filed: Feb. 21, 2020

(65) Prior Publication Data

US 2020/0194014 A1 Jun. 18, 2020

Related U.S. Application Data

(63) Continuation of application No. PCT/CN2018/101499, filed on Aug. 21, 2018.

(30) Foreign Application Priority Data

Aug. 23, 2017 (CN) ..... 201710731480.2

(51) Int. Cl.
*G10L 19/008* (2013.01)
*G10L 19/083* (2013.01)

(52) U.S. Cl.
CPC ..... *G10L 19/008* (2013.01); *G10L 19/083* (2013.01)

(58) Field of Classification Search
CPC ..... G10L 19/008; G10L 19/083
See application file for complete search history.

(56) References Cited

U.S. PATENT DOCUMENTS 6,578,162 B1 6/2003 Yung
7,783,049 B2 8/2010 Oh et al.
(Continued)

FOREIGN PATENT DOCUMENTS

CN 101025918 A 8/2007
CN 101141644 A 3/2008
(Continued)

OTHER PUBLICATIONS

PCT International Search Report and Written Opinion in International Application No. PCT/CN2018/101,499, dated Nov. 22, 2018, 18 pages (With English Translation).
(Continued)

*Primary Examiner* — Thai Q Tran
*Assistant Examiner* — Jose M Mesa
(74) *Attorney, Agent, or Firm* — Fish & Richardson P.C.

(57) ABSTRACT

Example signal reconstructing method and apparatus are described. One example method includes obtaining a reference sound channel and a target sound channel. An adaptive length of a transition segment is obtained based on an inter-channel time difference in the current frame and an initial length of the transition segment. A transition window in the current frame is obtained based on the adaptive length of the transition segment. A gain modification factor of a reconstructed signal is obtained. A transition segment signal on the target sound channel is obtained based on the inter-channel time difference, the adaptive length of the transition segment, the transition window, the gain modification factor, and a reference sound channel signal and a target sound channel signal.

20 Claims, 16 Drawing Sheets

(56) References Cited

U.S. PATENT DOCUMENTS

| | | | |
|---|---|---|---|
| 2006/0122830 | A1 | 6/2006 | Lee et al. |
| 2009/0164223 | A1 | 6/2009 | Fejzo |
| 2012/0134511 | A1 | 5/2012 | Vilermo et al. |
| 2015/0078571 | A1 | 3/2015 | Kurylo et al. |
| 2015/0221314 | A1 | 8/2015 | Disch et al. |
| 2017/0236521 | A1 | 8/2017 | Chebiyyam et al. |

FOREIGN PATENT DOCUMENTS

| | | | | | |
|---|---|---|---|---|---|
| CN | 102160113 | A | | 8/2011 | |
| CN | 103295577 | A | | 9/2013 | |
| CN | 105190747 | A | | 12/2015 | |
| CN | 105474312 | A | | 4/2016 | |
| EP | 1934973 | B1 | * | 11/2019 | ..... G10L 19/008 |
| JP | 2005533271 | A | | 11/2005 | |
| JP | 2019505017 | A | | 2/2019 | |
| KR | 20180056661 | A | | 5/2018 | |
| WO | WO-2007128523 | A1 | * | 11/2007 | ..... G10L 19/008 |
| WO | WO-2011086060 | A1 | * | 7/2011 | ..... G10L 19/008 |
| WO | 2014202788 | A1 | | 12/2014 | |
| WO | WO-2017103418 | A1 | * | 6/2017 | ..... G10L 19/008 |

OTHER PUBLICATIONS

Office Action issued in Japanese Application No. 2020-511333 dated Mar. 2, 2021, 6 pages (with English translation).

Office Action issued in Indian Application No. 202037008002 dated Mar. 31, 2021, 6 pages.

Extended European Search Report issued in European Application No. 18847759.0 dated May 4, 2020, 6 pages.

Fatus, "Parametric Coding for Spatial Audio," Master's Thesis, KTH Royal Institute of Technology, Dec. 2015, 70 pages.

Office Action issued in Korean Application No. 2020-7007651 dated Dec. 24, 2021, 6 pages (with English translation).

* cited by examiner

METHOD AND APPARATUS FOR RECONSTRUCTING SIGNAL DURING STEREO SIGNAL ENCODING

CROSS-REFERENCE TO RELATED APPLICATIONS

This application is a continuation of International Application No. PCT/CN2018/101499, filed on Aug. 21, 2018, which claims priority to Chinese Patent Application No. 201710731480.2, filed on Aug. 23, 2017. The disclosures of the aforementioned applications are hereby incorporated by reference in their entireties.

TECHNICAL FIELD

This application relates to the field of audio signal encoding/decoding technologies, and more specifically, to a method and an apparatus for reconstructing a stereo signal during stereo signal encoding.

BACKGROUND

A general process of encoding a stereo signal by using a time-domain stereo encoding technology includes the following steps:

estimating an inter-channel time difference of a stereo signal;

performing delay alignment processing on the stereo signal based on the inter-channel time difference;

performing, based on a parameter for time-domain downmixing processing, time-domain downmixing processing on a signal obtained after delay alignment processing, to obtain a primary sound channel signal and a secondary sound channel signal; and encoding the inter-channel time difference, the parameter for time-domain downmixing processing, the primary sound channel signal, and the secondary sound channel signal, to obtain an encoded bitstream.

A target sound channel with a delay may be adjusted when delay alignment processing is performed on the stereo signal based on the inter-channel time difference, then a forward signal on the target sound channel is manually determined, and a transition segment signal is generated between a real signal and the manually reconstructed forward signal on the target sound channel, so that the target sound channel and a reference sound channel have a same delay. However, smoothness of transition between the real signal and the manually reconstructed forward signal on the target sound channel in the current frame is comparatively poor due to the transition segment signal generated according to the existing solution.

SUMMARY

This application provides a method and an apparatus for reconstructing a signal during stereo signal encoding, so that smooth transition between a real signal on a target sound channel and a manually reconstructed forward signal can be implemented.

According to a first aspect, a method for reconstructing a signal during stereo signal encoding is provided. The method includes: determining a reference sound channel and a target sound channel in a current frame; determining an adaptive length of a transition segment in the current frame based on an inter-channel time difference in the current frame and an initial length of the transition segment in the current frame; determining a transition window in the current frame based on the adaptive length of the transition segment in the current frame; determining a gain modification factor of a reconstructed signal in the current frame; and determining a transition segment signal on the target sound channel in the current frame based on the inter-channel time difference in the current frame, the adaptive length of the transition segment in the current frame, the transition window in the current frame, the gain modification factor in the current frame, a reference sound channel signal in the current frame, and a target sound channel signal in the current frame.

The transition segment with the adaptive length is set, and the transition window is determined based on the adaptive length of the transition segment. Compared with a prior-art manner of determining the transition window by using a transition segment with a fixed length, a transition segment signal that can make smoother transition between a real signal on the target sound channel in the current frame and a manually reconstructed signal on the target sound channel in the current frame can be obtained.

With reference to the first aspect, in some implementations of the first aspect, the determining an adaptive length of a transition segment in the current frame based on an inter-channel time difference in the current frame and an initial length of the transition segment in the current frame includes: when an absolute value of the inter-channel time difference in the current frame is greater than or equal to the initial length of the transition segment in the current frame, determining the initial length of the transition segment in the current frame as the adaptive length of the transition segment in the current frame; or when an absolute value of the inter-channel time difference in the current frame is less than the initial length of the transition segment in the current frame, determining the absolute value of the inter-channel time difference in the current frame as the adaptive length of the transition segment.

The adaptive length of the transition segment in the current frame can be appropriately determined depending on a result of comparison between the inter-channel time difference in the current frame and the initial length of the transition segment in the current frame, and further the transition window with the adaptive length is determined. In this way, transition between a real signal and a manually reconstructed forward signal on the target sound channel in the current frame is smoother.

With reference to the first aspect, in some implementations of the first aspect, the transition segment signal on the target sound channel in the current frame satisfies the following formula:

$$\text{transition_seg}(i)=w(i)*g*\text{reference}(N-\text{adp_Ts}-\text{abs}(\text{cur_itd})+i)+(1-w(i))*\text{target}(N-\text{adp_Ts}+i),\quad \text{where } i=0,1,\ldots,\text{adp_Ts}-1,$$

transition_seg(.) represents the transition segment signal on the target sound channel in the current frame, adp_Ts represents the adaptive length of the transition segment in the current frame, w(.) represents the transition window in the current frame, g represents the gain modification factor in the current frame, target(.) represents the target sound channel signal in the current frame, reference(.) represents the reference sound channel signal in the current frame, cur_itd represents the inter-channel time difference in the current frame, abs(cur_itd) represents the absolute value of the inter-channel time difference in the current frame, and N represents a frame length of the current frame.

With reference to the first aspect, in some implementations of the first aspect, the determining a gain modification factor of a reconstructed signal in the current frame includes: determining an initial gain modification factor based on the transition window in the current frame, the adaptive length of the transition segment in the current frame, the target sound channel signal in the current frame, the reference sound channel signal in the current frame, and the inter-channel time difference in the current frame, where the initial gain modification factor is the gain modification factor in the current frame;

determining an initial gain modification factor based on the transition window in the current frame, the adaptive length of the transition segment in the current frame, the target sound channel signal in the current frame, the reference sound channel signal in the current frame, and the inter-channel time difference in the current frame; and modifying the initial gain modification factor based on a first modification coefficient to obtain the gain modification factor in the current frame, where the first modification coefficient is a preset real number greater than 0 and less than 1; or determining an initial gain modification factor based on the inter-channel time difference in the current frame, the target sound channel signal in the current frame, and the reference sound channel signal in the current frame; and modifying the initial gain modification factor based on a second modification coefficient to obtain the gain modification factor in the current frame, where the second modification coefficient is a preset real number greater than 0 and less than 1 or is determined according to a preset algorithm.

Optionally, the first modification coefficient is a preset real number greater than 0 and less than 1, and the second modification coefficient is a preset real number greater than 0 and less than 1.

When the gain modification factor is determined, in addition to the inter-channel time difference in the current frame, and the target sound channel signal and the reference sound channel signal in the current frame, the adaptive length of the transition segment in the current frame and the transition window in the current frame are further considered. In addition, the transition window in the current frame is determined based on the transition segment with the adaptive length. Compared with an existing solution in which the gain modification factor is determined based only on the inter-channel time difference in the current frame, the target sound channel signal in the current frame, and the reference sound channel signal in the current frame, energy consistency between a real signal on the target sound channel in the current frame and a reconstructed forward signal on the target sound channel in the current frame is considered. Therefore, the obtained forward signal on the target sound channel in the current frame is more approximate to a real forward signal on the target sound channel in the current frame, that is, the reconstructed forward signal in this application is more accurate than that in the existing solution.

In addition, the gain modification factor is modified by using the first modification coefficient, so that energy of the finally obtained transition segment signal and forward signal in the current frame can be appropriately reduced, and impact made, on a linear prediction analysis result obtained by using a mono coding algorithm during stereo encoding, by a difference between the manually reconstructed forward signal on the target sound channel and the real forward signal on the target sound channel can be further reduced.

The gain modification factor is modified by using the second modification coefficient, so that the finally obtained transition segment signal and forward signal in the current frame is more accurate, and impact made, on the linear prediction analysis result obtained by using the mono coding algorithm during stereo encoding, by the difference between the manually reconstructed forward signal on the target sound channel and the real forward signal on the target sound channel can be reduced.

With reference to the first aspect, in some implementations of the first aspect, the initial gain modification factor satisfies the following formula:

$$g = \frac{-b + \sqrt{b^2 - 4ac}}{2a},$$

where $$a = \frac{1}{N - T_0}\sum_{i=T_d}^{N-1} y^2(i) + \left[\sum_{i=T_s}^{T_d-1} w(i - T_s)\cdot y(i)\right]^2,$$

$$b = \frac{2}{N - T_0}\sum_{i=T_s}^{T_d-1} [1 - w(i - T_s)]\cdot x(i + \text{abs(cur_itd)})\cdot w(i - T_s)\cdot y(i),$$

and $$c = \frac{1}{N - T_0}\left[\sum_{i=T_0}^{T_b-1} x^2(i + \text{abs(cur_itd)}) + \sum_{i=T_g}^{T_d-1} [[1 - w(i - T_g)]x(i + \text{abs(cur_itd)})]^2\right] - \frac{K}{T_d - T_0}\sum_{i=T_0}^{T_d-1} x^2(i),$$

where

K represents an energy attenuation coefficient, K is a preset real number, and $0<K\leq 1$; g represents the gain modification factor in the current frame; w(.) represents the transition window in the current frame; x(.) represents the target sound channel signal in the current frame; y(.) represents the reference sound channel signal in the current frame; N represents the frame length of the current frame; $T_s$ represents a sampling point index that is of the target sound channel and that corresponds to a start sampling point index of the transition window; $T_d$ represents a sampling point index that is of the target sound channel and that corresponds to an end sampling point index of the transition window, $T_s$=N−abs(cur_itd)−adp_Ts, $T_d$=N−abs(cur_itd), $T_0$ represents a preset start sampling point index that is of the target sound channel and that is used to calculate the gain modification factor, and $0\leq T_0<T_s$; cur_itd represents the inter-channel time difference in the current frame; abs(cur_itd) represents the absolute value of the inter-channel time difference in the current frame; and adp_Ts represents the adaptive length of the transition segment in the current frame.

With reference to the first aspect, in some implementations of the first aspect, the method further includes: determining a forward signal on the target sound channel in the current frame based on the inter-channel time difference in the current frame, the gain modification factor in the current frame, and the reference sound channel signal in the current frame.

With reference to the first aspect, in some implementations of the first aspect, the forward signal on the target sound channel in the current frame satisfies the following formula:

reconstruction_seg($i$)=$g$*reference($N$−abs(cur_itd)+$i$), where $i$=0,1, . . . ,abs(cur_itd)

reconstruction_seg(.) represents the forward signal on the target sound channel in the current frame, g represents the gain modification factor in the current frame, reference(.) represents the reference sound channel signal in the current frame, cur_itd represents the inter-channel time difference in the current frame, abs(cur_itd) represents the absolute value of the inter-channel time difference in the current frame, and N represents the frame length of the current frame.

With reference to the first aspect, in some implementations of the first aspect, when the second modification coefficient is determined according to the preset algorithm, the second modification coefficient is determined based on the reference sound channel signal and the target sound channel signal in the current frame, the inter-channel time difference in the current frame, the adaptive length of the transition segment in the current frame, the transition window in the current frame, and the gain modification factor in the current frame.

With reference to the first aspect, in some implementations of the first aspect, the second modification coefficient satisfies the following formula:

$$\text{adj_fac} = \frac{\frac{K}{T_d - T_0}\sum_{i=T_0}^{T_d-1} x^2(i)}{\frac{1}{N - T_s}\left[\sum_{i=T_s}^{T_d-1} [[1 - w(i - T_s)] \cdot x(i + \text{abs(cur_itd)}) + w(i - T_s) \cdot g \cdot y(i)]^2 + \sum_{i=T_d}^{N-1} g^2 \cdot y^2(i)\right]},$$

where adj_fac represents the second modification coefficient; K represents the energy attenuation coefficient, K is the preset real number, and 0<K≤1; g represents the gain modification factor in the current frame; w(.) represents the transition window in the current frame; x(.) represents the target sound channel signal in the current frame; y(.) represents the reference sound channel signal in the current frame; N represents the frame length of the current frame; $T_s$ represents the sampling point index that is of the target sound channel and that corresponds to the start sampling point index of the transition window, $T_d$ represents the sampling point index that is of the target sound channel and that corresponds to the end sampling point index of the transition window, $T_s$=N−abs(cur_itd)−adp_Ts, $T_d$=N−abs(cur_itd), $T_0$ represents the preset start sampling point index of the target sound channel used to calculate the gain modification factor, and $0 \le T_0 < T_s$; cur_itd represents the inter-channel time difference in the current frame, abs(cur_itd) represents the absolute value of the inter-channel time difference in the current frame; and adp_Ts represents the adaptive length of the transition segment in the current frame.

With reference to the first aspect, in some implementations of the first aspect, the second modification coefficient satisfies the following formula:

$$\text{adj_fac} = \frac{\frac{K}{T_d - T_0}\sum_{i=T_0}^{T_d-1} x^2(i)}{\frac{1}{N - T_0}\left[\sum_{i=T_0}^{T_d-1} x^2(i + \text{abs(cur_itd)}) + \sum_{i=T_2}^{T_d-1} [[1 - w(i - T_s)] \cdot x(i + \text{abs(cur_itd)}) + w(i - T_s) \cdot g \cdot y(i)]^2 + \sum_{i=T_d}^{N-1} g^2 \cdot y^2(i)\right]},$$

where adj_fac represents the second modification coefficient, K represents the energy attenuation coefficient, K is the preset real number, and 0<K≤1; g represents the gain modification factor in the current frame; w(.) represents the transition window in the current frame; x(.) represents the target sound channel signal in the current frame; y(.) represents the reference sound channel signal in the current frame; N represents the frame length of the current frame; $T_s$ represents the sampling point index that is of the target sound channel and that corresponds to the start sampling point index of the transition window, $T_d$ represents the sampling point index that is of the target sound channel and that corresponds to the end sampling point index of the transition window, $T_s$=N−abs(cur_itd)−adp_Ts, $T_d$=N−abs(cur_itd), $T_0$ represents the preset start sampling point index that is of the target sound channel and that is used to calculate the gain modification factor, and $0 \le T_0 < T_s$; cur_itd represents the inter-channel time difference in the current frame; abs(cur_itd) represents the absolute value of the inter-channel time difference in the current frame; and adp_Ts represents the adaptive length of the transition segment in the current frame.

With reference to the first aspect, in some implementations of the first aspect, the forward signal on the target sound channel in the current frame satisfies the following formula:

reconstruction_seg($i$)=$g$_mod*reference($N$−abs(cur_itd)+$i$), where reconstruction_seg(i) is a value of the forward signal at a sampling point i on the target sound channel in the current frame, g_mod represents the gain modification factor, reference(.) represents the reference sound channel signal in the current frame, cur_itd represents the inter-channel time difference in the current frame, abs(cur_itd) represents the absolute value of the inter-channel time difference in the current frame, N represents the frame length of the current frame, and i=0, 1, . . . , abs(cur_itd)−1.

With reference to the first aspect, in some implementations of the first aspect, the transition segment signal on the target sound channel in the current frame satisfies the following formula:

transition_seg($i$)=$w$($i$)*$g$_mod*reference($N$−adp_Ts−abs(cur_itd)+$i$)+(1−$w$($i$))*target($N$−adp_Ts+$i$), where transition_seg(.) represents the transition segment signal on the target sound channel in the current frame, adp_Ts represents the adaptive length of the transition segment in the current frame, w(.) represents the transition window in the current frame, g_mod represents the modified gain modification factor, target(.) represents the target sound channel signal in the current frame, reference(.) represents the reference sound channel signal in the current frame, cur_itd represents the inter-channel time difference in the current frame, abs(cur_itd) represents the absolute value of the inter-channel time difference in the current frame, and N represents the frame length of the current frame.

According to a second aspect, a method for reconstructing a signal during stereo signal encoding is provided. The method includes: determining a reference sound channel and a target sound channel in a current frame; determining an adaptive length of a transition segment in the current frame based on an inter-channel time difference in the current frame and an initial length of the transition segment in the current frame; determining a transition window in the current frame based on the adaptive length of the transition segment in the current frame; and determining a transition segment signal on the target sound channel in the current frame based on the adaptive length of the transition segment in the current frame, the transition window in the current frame, and a target sound channel signal in the current frame.

The transition segment with the adaptive length is set, and the transition window is determined based on the adaptive length of the transition segment. Compared with a prior-art manner of determining the transition window by using a transition segment with a fixed length, a transition segment signal that can make smoother transition between a real signal on the target sound channel in the current frame and a manually reconstructed signal on the target sound channel in the current frame can be obtained.

With reference to the second aspect, in some implementations of the second aspect, the method further includes: setting a forward signal on the target sound channel in the current frame to zero.

The forward signal on the target sound channel is set to zero, so that calculation complexity can be further reduced.

With reference to the second aspect, in some implementations of the second aspect, the determining an adaptive length of a transition segment in the current frame based on an inter-channel time difference in the current frame and an initial length of the transition segment in the current frame includes: when an absolute value of the inter-channel time difference in the current frame is greater than or equal to the initial length of the transition segment in the current frame, determining the initial length of the transition segment in the current frame as the adaptive length of the transition segment in the current frame; or when an absolute value of the inter-channel time difference in the current frame is less than the initial length of the transition segment in the current frame, determining the absolute value of the inter-channel time difference in the current frame as the adaptive length of the transition segment.

The adaptive length of the transition segment in the current frame can be appropriately determined depending on a result of comparison between the inter-channel time difference in the current frame and the initial length of the transition segment in the current frame, and further the transition window with the adaptive length is determined. In this way, transition between a real signal and a manually reconstructed forward signal on the target sound channel in the current frame is smoother.

With reference to the second aspect, in some implementations of the second aspect, the transition segment signal on the target sound channel in the current frame satisfies the following formula: transition_seg(i)=(1−w(i))*target(N−adp_Ts+i), where i=0, 1, . . . , adp_Ts−1, transition_seg(.) represents the transition segment signal on the target sound channel in the current frame, adp_Ts represents the adaptive length of the transition segment in the current frame, w(.) represents the transition window in the current frame, target(.) represents the target sound channel signal in the current frame, cur_itd represents the inter-channel time difference in the current frame, abs(cur_itd) represents the absolute value of the inter-channel time difference in the current frame, and N represents a frame length of the current frame.

According to a third aspect, an encoding apparatus is provided. The encoding apparatus includes a module for performing the method in any one of the first aspect or the possible implementations of the first aspect.

According to a fourth aspect, an encoding apparatus is provided. The encoding apparatus includes a module for performing the method in any one of the second aspect or the possible implementations of the second aspect.

According to a fifth aspect, an encoding apparatus is provided, including a memory and a processor. The memory is configured to store a program, and the processor is configured to execute the program. When the program is executed, the processor performs the method in any one of the first aspect or the possible implementations of the first aspect.

According to a sixth aspect, an encoding apparatus is provided, including a memory and a processor. The memory is configured to store a program, and the processor is configured to execute the program. When the program is executed, the processor performs the method in any one of the second aspect or the possible implementations of the second aspect.

According to a seventh aspect, a computer readable storage medium is provided. The computer readable storage medium is configured to store program code executed by a device, and the program code includes an instruction used to perform the method in any one of the first aspect or the implementations of the first aspect.

According to an eighth aspect, a computer readable storage medium is provided. The computer readable storage medium is configured to store program code executed by a device, and the program code includes an instruction used to perform the method in any one of the second aspect or the implementations of the second aspect.

According to a ninth aspect, a chip is provided. The chip includes a processor and a communications interface. The communications interface is configured to communicate with an external component, and the processor is configured to perform the method in any one of the first aspect or the possible implementations of the first aspect.

Optionally, in an implementation, the chip may further include a memory. The memory stores an instruction, and the processor is configured to execute the instruction stored in the memory. When the instruction is executed, the processor is configured to perform the method in any one of the first aspect or the possible implementations of the first aspect.

Optionally, in an implementation, the chip is integrated into a terminal device or a network device.

According to a tenth aspect, a chip is provided. The chip includes a processor and a communications interface. The communications interface is configured to communicate with an external component, and the processor is configured to perform the method in any one of the second aspect or the possible implementations of the second aspect.

Optionally, in an implementation, the chip may further include a memory. The memory stores an instruction, and the processor is configured to execute the instruction stored in the memory. When the instruction is executed, the processor is configured to perform the method in any one of the second aspect or the possible implementations of the second aspect.

Optionally, in an implementation, the chip is integrated into a network device or a terminal device.

DESCRIPTION OF EMBODIMENTS

The following describes technical solutions of this application with reference to accompanying drawings.

Figure 1:
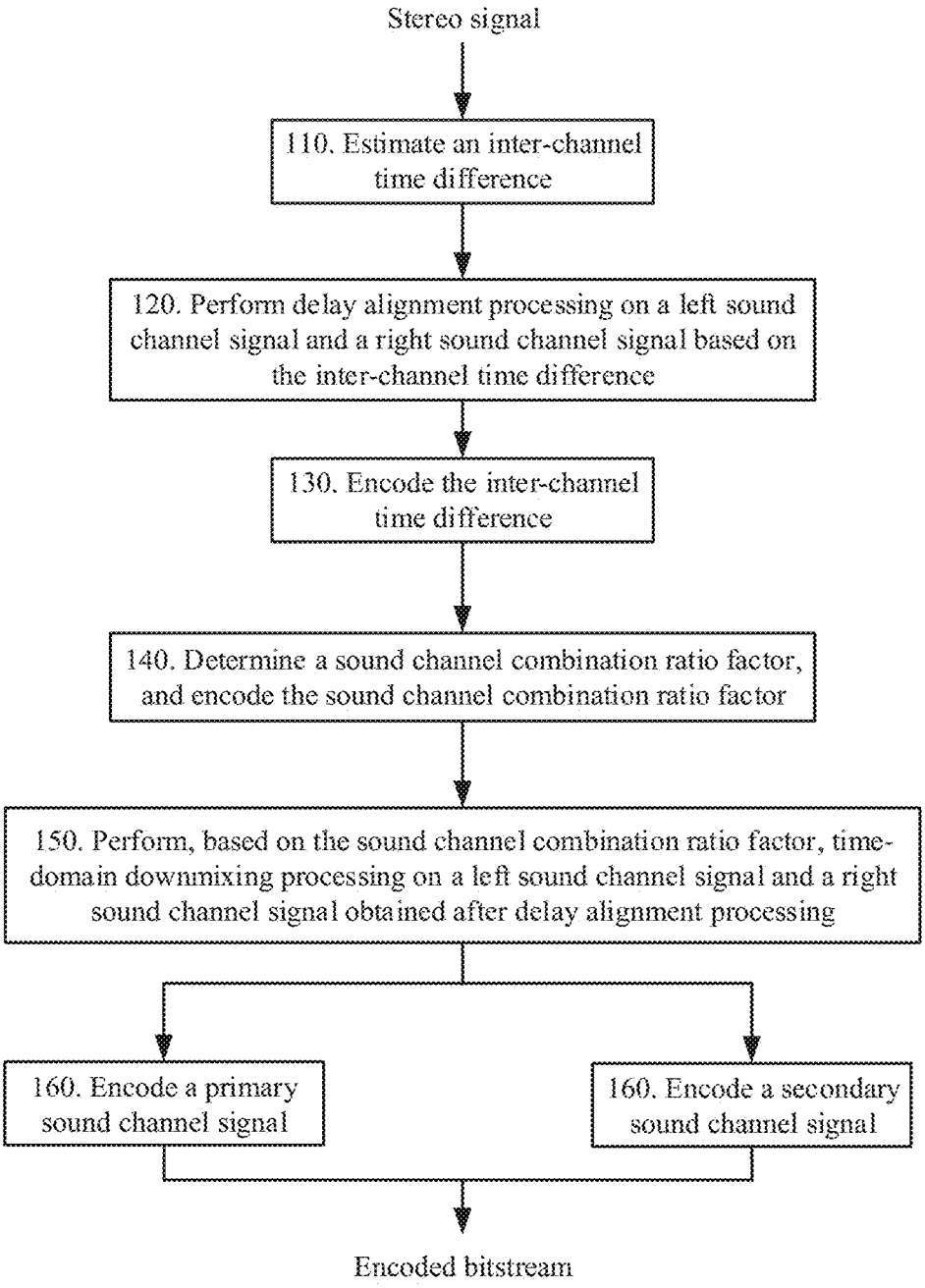
FIG. 1 is a schematic flowchart of a time-domain stereo encoding method.
Figure 2:
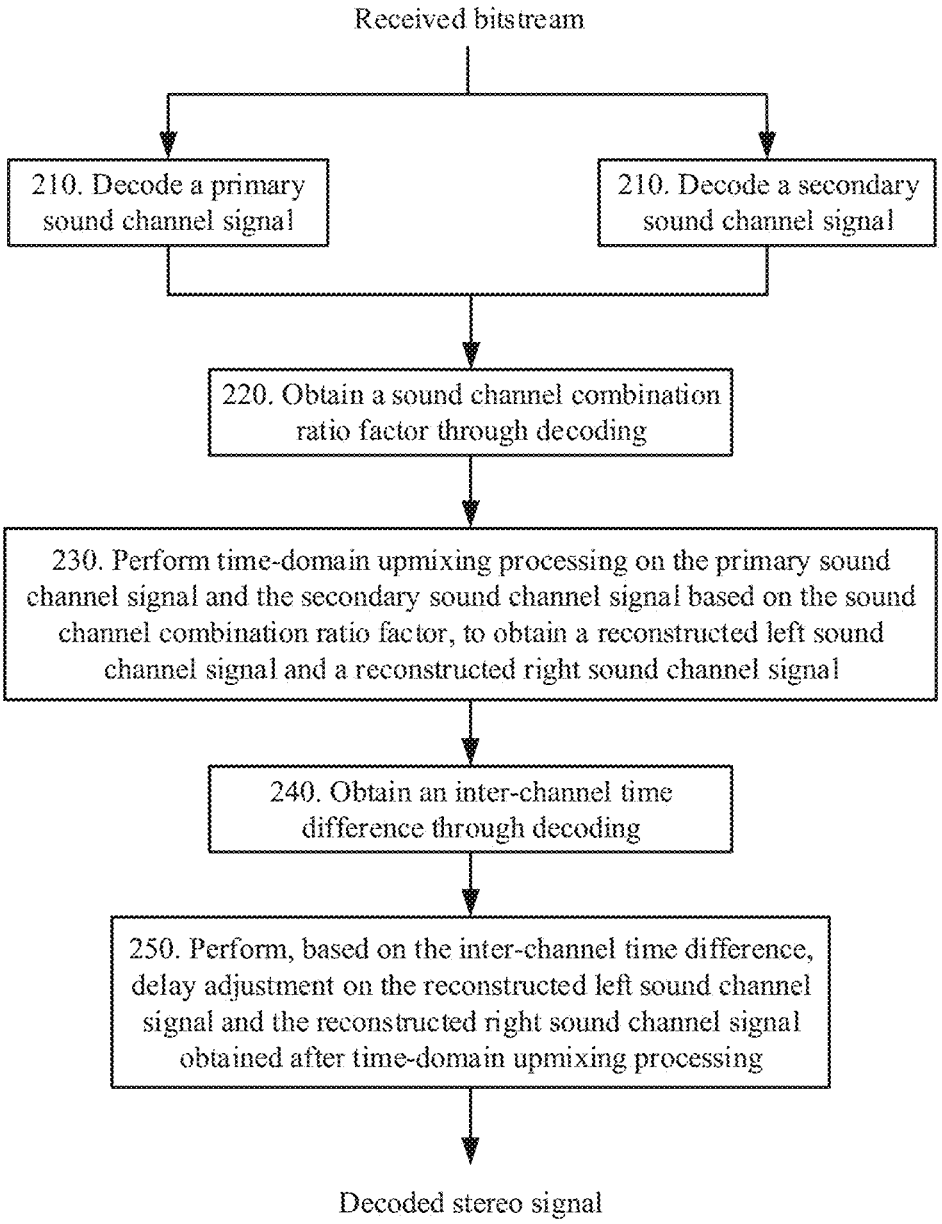
FIG. 2 is a schematic flowchart of a time-domain stereo decoding method.

To facilitate understanding of a method for reconstructing a signal during stereo signal encoding in the embodiments of this application, the following first generally describes an entire encoding/decoding process of a time-domain stereo encoding/decoding method with reference to FIG. 1 and FIG. 2.

It should be understood that a stereo signal in this application may be a raw stereo signal, a stereo signal including two signals included in a multichannel signal, or a stereo signal including two signals jointly generated by a plurality of signals included in a multichannel signal. A stereo signal encoding method may also be a stereo signal encoding method used in a multichannel signal encoding method.

FIG. 1 is a schematic flowchart of a time-domain stereo encoding method. The encoding method 100 specifically includes the following steps.

110. An encoder side estimates an inter-channel time difference of a stereo signal, to obtain the inter-channel time difference of the stereo signal.

The stereo signal includes a left sound channel signal and a right sound channel signal. The inter-channel time difference of the stereo signal is a time difference between the left sound channel signal and the right sound channel signal.

120. Perform delay alignment processing on the left sound channel signal and the right sound channel signal based on the inter-channel time difference obtained through estimation.

130. Encode the inter-channel time difference of the stereo signal to obtain an encoding index of the inter-channel time difference, and write the encoding index into a stereo encoded bitstream.

140. Determine a sound channel combination ratio factor, encode the sound channel combination ratio factor to obtain an encoding index of the sound channel combination ratio factor, and write the encoding index into the stereo encoded bitstream.

150. Perform, based on the sound channel combination ratio factor, time-domain downmixing processing on a left sound channel signal and a right sound channel signal obtained after delay alignment processing.

160. Separately encode a primary sound channel signal and a secondary sound channel signal obtained after downmixing processing, to obtain a bitstream including the primary sound channel signal and the secondary sound channel signal, and write the bitstream into the stereo encoded bitstream.

FIG. 2 is a schematic flowchart of a time-domain stereo decoding method. The decoding method 200 specifically includes the following steps.

210. Obtain a primary sound channel signal and a secondary sound channel signal through decoding based on a received bitstream.

The bitstream in step 210 may be received by a decoder side from an encoder side. In addition, step 210 is equivalent to separately decoding the primary sound channel signal and the secondary sound channel signal, to obtain the primary sound channel signal and the secondary sound channel signal.

220. Obtain a sound channel combination ratio factor through decoding based on the received bitstream.

230. Perform time-domain upmixing processing on the primary sound channel signal and the secondary sound channel signal based on the sound channel combination ratio factor, to obtain a reconstructed left sound channel signal and a reconstructed right sound channel signal obtained after time-domain upmixing processing.

240. Obtain an inter-channel time difference through decoding based on the received bitstream.

250. Perform, based on the inter-channel time difference, delay adjustment on the reconstructed left sound channel signal and the reconstructed right sound channel signal obtained after time-domain upmixing processing, to obtain a decoded stereo signal.

In a delay alignment processing process (for example, step 120), if a target sound channel with a later arrival time is adjusted based on the inter-channel time difference, to have a same delay as a reference sound channel, a forward signal on the target sound channel needs to be manually reconstructed during delay alignment processing. In addition, to improve smoothness of transition between a real signal on the target sound channel and the reconstructed forward signal on the target sound channel, a transition segment signal is generated between the real signal and the manually reconstructed forward signal on the target sound channel in a current frame. In an existing solution, a transition segment signal in a current frame is usually determined based on an inter-channel time difference in the current frame, an initial length of a transition segment in the current frame, a transition window function in the current frame, a gain modification factor in the current frame, and a reference sound channel signal and a target sound channel signal in the current frame. However, the initial length of the transition segment is fixed, and cannot be flexibly adjusted based on different values of the inter-channel time difference. Therefore, smooth transition between the real signal and the manually reconstructed forward signal on the target sound channel cannot be well implemented due to the transition segment signal generated according to the existing solution (in other words, smoothness of transition between the real signal and the manually reconstructed forward signal on the target sound channel is comparatively poor).

This application proposes a method for reconstructing a signal during stereo encoding. In the method, a transition segment signal is generated by using an adaptive length of a transition segment, and the adaptive length of the transition segment is determined by considering an inter-channel time difference in a current frame and an initial length of the transition segment. Therefore, the transition segment signal generated according to this application can be used to improve smoothness of transition between a real signal and a manually reconstructed forward signal on a target sound channel in the current frame.

Figure 3:
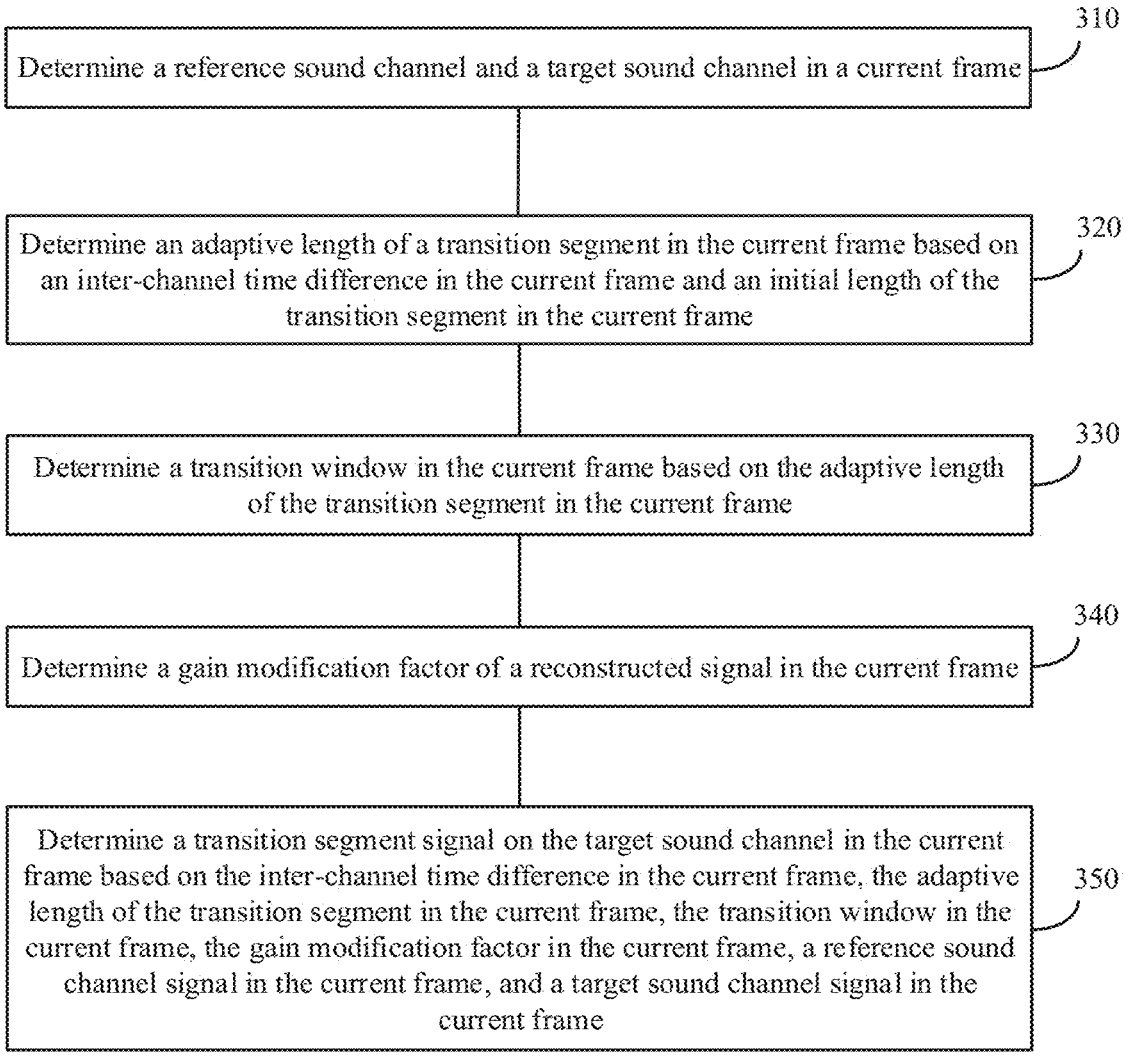
FIG. 3 is a schematic flowchart of a method for reconstructing a signal during stereo signal encoding according to an embodiment of this application.

FIG. 3 is a schematic flowchart of a method for reconstructing a signal during stereo signal encoding according to an embodiment of this application. The method 300 may be performed by an encoder side. The encoder side may be an encoder or a device with a stereo signal encoding function. The method 300 specifically includes the following steps.

310. Determine a reference sound channel and a target sound channel in a current frame.

It should be understood that a stereo signal processed by using the method 300 includes a left sound channel signal and a right sound channel signal.

Optionally, when the reference sound channel and the target sound channel in the current frame are determined, a sound channel with a later arrival time may be determined as the target sound channel, and the other sound channel with an earlier arrival time is determined as the reference sound channel. For example, if an arrival time of a left sound channel lags behind an arrival time of a right sound channel, the left sound channel may be determined as the target sound channel, and the right sound channel may be determined as the reference sound channel.

Optionally, the reference sound channel and the target sound channel in the current frame may be determined based on an inter-channel time difference in the current frame, and a specific determining process is described as follows:

First, an inter-channel time difference obtained through estimation in the current frame is used as the inter-channel time difference cur_itd in the current frame.

Then, the target sound channel and the reference sound channel in the current frame are determined depending on a result of comparison between the inter-channel time difference in the current frame and an inter-channel time difference (denoted as prev_itd) in a previous frame of the current frame. Specifically, the following three cases may be included.

Case 1:

If cur_itd=0, the target sound channel in the current frame remains consistent with a target sound channel in the previous frame, and the reference sound channel in the current frame remains consistent with a reference sound channel in the previous frame.

For example, if an index of the target sound channel in the current frame is denoted as target_idx, and an index of the target sound channel in the previous frame of the current frame is denoted as prev_target_idx, the index of the target sound channel in the current frame is the same as the index of the target sound channel in the previous frame, that is, target_idx=prev_target_idx.

Case 2:

If cur_itd<0, the target sound channel in the current frame is a left sound channel, and the reference sound channel in the current frame is a right sound channel.

For example, if an index of the target sound channel in the current frame is denoted as target_idx, target_idx=0 (an index number being 0 indicates that the target sound channel is the left sound channel, and an index number being 1 indicates that the target sound channel is the right sound channel).

Case 3:

If cur_itd>0, the target sound channel in the current frame is a right sound channel, and the reference sound channel in the current frame is the left sound channel.

For example, if an index of the target sound channel in the current frame is denoted as target_idx, target_idx=1 (an index number being 0 indicates that the target sound channel is the left sound channel, and an index number being 1 indicates that the target sound channel is the right sound channel).

It should be understood that the inter-channel time difference cur_itd in the current frame may be obtained by estimating the inter-channel time difference between the left sound channel signal and the right sound channel signal. When the inter-channel time difference is estimated, a cross-correlation coefficient between the left sound channel and the right sound channel may be calculated based on the left sound channel signal and the right sound channel signal in the current frame, and then an index value corresponding to a maximum value of the cross-correlation coefficient is used as the inter-channel time difference in the current frame.

320. Determine an adaptive length of a transition segment in the current frame based on the inter-channel time difference in the current frame and an initial length of the transition segment in the current frame.

Optionally, in an embodiment, the determining an adaptive length of a transition segment in the current frame based on the inter-channel time difference in the current frame and an initial length of the transition segment in the current frame includes: when an absolute value of the inter-channel time difference in the current frame is greater than or equal to the initial length of the transition segment in the current frame, determining the initial length of the transition segment in the current frame as the adaptive length of the transition segment in the current frame; or when an absolute value of the inter-channel time difference in the current frame is less than the initial length of the transition segment in the current frame, determining the absolute value of the inter-channel time difference in the current frame as the adaptive length of the transition segment.

When the absolute value of the inter-channel time difference in the current frame is less than the initial length of the transition segment in the current frame, depending on a result of comparison between the inter-channel time difference in the current frame and the initial length of the transition segment in the current frame, a length of the transition segment can be appropriately reduced, the adaptive length of the transition segment in the current frame is appropriately determined, and further a transition window with the adaptive length is determined. In this way, transition between a real signal and a manually reconstructed forward signal on the target sound channel in the current frame is smoother.

Specifically, the adaptive length of the transition segment satisfies the following Formula (1). Therefore, the adaptive length of the transition segment may be determined according to Formula (1).

$$\text{adp_Ts} = \begin{cases} Ts\ 2, & \text{abs(cur_itd)} \geq Ts\ 2 \\ \text{abs(cur_itd)}, & \text{abs(cur_itd)} < Ts\ 2 \end{cases} \quad (1)$$

cur_itd represents the inter-channel time difference in the current frame, abs(cur_itd) represents the absolute value of the inter-channel time difference in the current frame, and Ts2 represents the preset initial length of the transition segment, where the initial length of the transition segment may be a preset positive integer. For example, when a sampling rate is 16 kHz, Ts2 is set to 10.

In addition, with regard to different sampling rates, Ts2 may be set to a same value or different values.

It should be understood that the inter-channel time difference in the current frame described following step 310 and the inter-channel time difference in the current frame described in step 320 may be obtained by estimating the inter-channel time difference between the left sound channel signal and the right sound channel signal.

When the inter-channel time difference is estimated, the cross-correlation coefficient between the left sound channel and the right sound channel may be calculated based on the left sound channel signal and the right sound channel signal in the current frame, and then the index value corresponding to the maximum value of the cross-correlation coefficient is used as the inter-channel time difference in the current frame.

Specifically, the inter-channel time difference may be estimated in manners in Example 1 to Example 3.

Example 1

At a current sampling rate, a maximum value and a minimum value of the inter-channel time difference are $T_{max}$ and $T_{min}$, respectively, where $T_{max}$ and $T_{min}$ are preset real numbers, and $T_{max}>T_{min}$. Therefore, a maximum value of the cross-correlation coefficient between the left sound channel and the right sound channel is searched for between the maximum value and the minimum value of the inter-channel time difference. Finally, an index value corresponding to the found maximum value of the cross-correlation coefficient between the left sound channel and the right sound channel is determined as the inter-channel time difference in the current frame. For example, values of $T_{max}$ and $T_{min}$ may be 40 and −40. Therefore, a maximum value of the cross-correlation coefficient between the left sound channel and the right sound channel is searched for in a range of $-40 \leq i \leq 40$. Then, an index value corresponding to the maximum value of the cross-correlation coefficient is used as the inter-channel time difference in the current frame.

Example 2

At a current sampling rate, a maximum value and a minimum value of the inter-channel time difference are $T_{max}$ and $T_{min}$, where $T_{max}$ and $T_{min}$ are preset real numbers, and $T_{max}>T_{min}$. Therefore, a cross-correlation function between the left sound channel and the right sound channel may be calculated based on the left sound channel signal and the right sound channel signal in the current frame. Then, smoothness processing is performed on the calculated cross-correlation function between the left sound channel and the right sound channel in the current frame according to a cross-correlation function between the left sound channel and the right sound channel in L frames (where L is an integer greater than or equal to 1) previous to the current frame, to obtain a cross-correlation function between the left sound channel and the right sound channel obtained after smoothness processing. Next, a maximum value of the cross-correlation function between the left sound channel and the right sound channel obtained after smoothness processing is searched for in a range of $T_{min} \leq i \leq T_{max}$, and an index value i corresponding to the maximum value is used as the inter-channel time difference in the current frame.

Example 3

After the inter-channel time difference in the current frame is estimated according to Example 1 or Example 2, inter-frame smoothness processing is performed on inter-channel time differences in M (where M is an integer greater than or equal to 1) frames previous to the current frame and the estimated inter-channel time difference in the current frame, and an inter-channel time difference obtained after smoothness processing is used as a final inter-channel time difference in the current frame.

It should be understood that, before the time difference is estimated between the left sound channel signal and the right sound channel signal (where the left sound channel signal and the right sound channel signal herein are time-domain signals), time-domain preprocessing may be performed on the left sound channel signal and the right sound channel signal in the current frame.

Specifically, high-pass filtering processing may be performed on the left sound channel signal and the right sound channel signal in the current frame, to obtain a preprocessed left sound channel signal and a preprocessed left sound channel signal in the current frame. In addition, the time-domain preprocessing herein may be other processing such as pre-emphasis processing, in addition to high-pass filtering processing.

For example, if a sampling rate of a stereo audio signal is 16 kHz, and each frame of signal is 20 ms, a frame length is N=320, that is, each frame includes 320 sampling points. The stereo signal in the current frame includes a left-channel time-domain signal $x_L(n)$ in the current frame and a right-channel time-domain signal $x_R(n)$ in the current frame, where n represents a sampling point number, and n=0, 1, . . . , and N−1. Then time-domain preprocessing is performed on the left-channel time-domain signal $x_L(n)$ in the current frame and right-channel time-domain signal $x_R(n)$ in the current frame, to obtain a preprocessed left-channel time-domain signal $\tilde{x}_L(n)$ in the current frame and a preprocessed right-channel time-domain signal $\tilde{x}_R(n)$ in the current frame.

It should be understood that performing time-domain preprocessing on the left-channel time-domain signal and the right-channel time-domain signal in the current frame is not a necessary step. If there is no step of performing time-domain preprocessing, the left sound channel signal and the right sound channel signal between which the inter-channel time difference is estimated are a left sound channel signal and a right sound channel signal in a raw stereo signal. The left sound channel signal and the right sound channel signal in the raw stereo signal may be collected pulse code modulation (PCM) signals obtained through analog-to-digital (A/D) conversion. In addition, the sampling rate of the stereo audio signal may be 8 kHz, 16 kHz, 32 kHz, 44.1 kHz, 48 kHz, or the like.

330. Determine a transition window in the current frame based on the adaptive length of the transition segment in the current frame, where the adaptive length of the transition segment is a window length of the transition window.

Optionally, the transition window in the current frame may be determined according to Formula (2):

$$w(i) = \sin\left(\frac{\pi}{2 * \text{adp_Ts}}(0.5 + i)\right), \quad \text{where } i = 0, 1, \ldots, \text{adp_Ts} - 1 \tag{2}$$

Herein, sin(.) represents a sinusoidal operation, and adp_Ts represents the adaptive length of the transition segment.

It should be understood that a shape of the transition window in the current frame is not specifically limited in this application, provided that the window length of the transition window is the adaptive length of the transition segment.

In addition to determining the transition window according to Formula (2), the transition window in the current frame may alternatively be determined according to the following Formula (3) or Formula (4):

$$w(i) = 0.5 + 0.5 * \cos\left(\frac{\pi * i}{\text{adp_Ts}}\right), \quad \text{where } i = 0, 1, \ldots, \text{adp_Ts} - 1 \tag{3}$$

$$w(i) = 1 - \cos\left(\frac{\pi * i}{2 * \text{adp_Ts}}\right), \quad \text{where } i = 0, 1, \ldots, \text{adp_Ts} - 1 \tag{4}$$

In Formula (3) and Formula (4), cos(.) represents a cosine operation, and adp_Ts represents the adaptive length of the transition segment.

340. Determine a gain modification factor of a reconstructed signal in the current frame.

It should be understood that, the gain modification factor of the reconstructed signal in the current frame may be briefly referred to as a gain modification factor in the current frame in this specification.

350. Determine a transition segment signal on the target sound channel in the current frame based on the inter-channel time difference in the current frame, the adaptive length of the transition segment in the current frame, the transition window in the current frame, the gain modification factor in the current frame, a reference sound channel signal in the current frame, and a target sound channel signal in the current frame.

Optionally, the transition segment signal in the current frame satisfies the following Formula (5). Therefore, the transition segment signal on the target sound channel in the current frame may be determined according to Formula (5):

$$\text{transition_seg}(i) = w(i) * g * \text{reference}(N - \text{adp_Ts} - \text{abs}(\text{cur_itd}) + i) + (1 - w(i)) * \text{target}(N - \text{adp_Ts} + i), \quad \text{where } i = 0, 1, \ldots, \text{adp_Ts} - 1 \tag{5}$$

transition_seg(.) represents the transition segment signal on the target sound channel in the current frame, adp_Ts represents the adaptive length of the transition segment in the current frame, w(.) represents the transition window in the current frame, g represents the gain modification factor in the current frame, target(.) represents the target sound channel signal in the current frame, reference(.) represents the reference sound channel signal in the current frame, cur_itd represents the inter-channel time difference in the current frame, abs(cur_itd) represents the absolute value of the inter-channel time difference in the current frame, and N represents a frame length of the current frame.

Specifically, transition_seg(i) is a value of the transition segment signal on the target sound channel in the current frame at a sampling point i, w(i) is a value of the transition window in the current frame at the sampling point i, target (N−adp_Ts+i) is a value of the target sound channel signal in the current frame at a sampling point (N−adp_Ts+i), and reference(N−adp_Ts−abs(cur_itd)+i) is a value of the reference sound channel signal in the current frame at a sampling point (N−adp_Ts−abs(cur_itd)+i).

In Formula (5), i ranges from 0 to adp_Ts−1. Therefore, determining the transition segment signal on the target sound channel in the current frame according to Formula (5) is equivalent to manually reconstructing a signal with a length of adp_Ts points based on the gain modification factor g in the current frame, values from a point 0 to a point (adp_Ts−1) of the transition window in the current frame, values from a sampling point (N−abs(cur_itd)−adp_Ts) to a sampling point (N−abs(cur_itd)−1) on the reference sound channel in the current frame, and values from a sampling point (N−adp_Ts) to a sampling point (N−1) on the target sound channel in the current frame, and the manually reconstructed signal with the length of the adp_Ts points is determined as a signal from the point 0 to the point (adp_Ts−1) of the transition segment signal on the target sound channel in the current frame. Further, after the transition segment signal in the current frame is determined, the value of the sampling point 0 to the value of the sampling point (adp_Ts−1) of the transition segment signal on the target sound channel in the current frame may be used as a value of the sampling point (N−adp_Ts) to a value of the sampling point (N−1) on the target sound channel after delay alignment processing.

It should be understood that the signal from the point (N−adp_Ts) to the point (N−1) on the target sound channel after delay alignment processing may be further directly determined according to Formula (6):

$$\text{target_alig}(N-\text{adp_Ts}+i)=w(i)*g*\text{reference}(N-\text{adp_Ts}-\text{abs}(\text{cur_itd})+i)+(1-w(i))*\text{target}(N-\text{adp_Ts}+i),\ \text{where } i=0,1,\ldots,\text{adp_Ts}-1 \quad (6)$$

Herein, target_alig(N−adp_Ts+i) is a value of a sampling point (N−adp_Ts+i) on the target sound channel after delay alignment processing, w(i) is a value of the transition window in the current frame at the sampling point i, target (N−adp_Ts+i) is a value of the target sound channel signal in the current frame at the sampling point (N−adp_Ts+i), reference(N−adp_Ts−abs(cur_itd)+i) is a value of the reference sound channel signal in the current frame at the sampling point (N−adp_Ts−abs(cur_itd)+i), g represents the gain modification factor in the current frame, adp_Ts represents the adaptive length of the transition segment in the current frame, cur_itd represents the inter-channel time difference in the current frame, abs(cur_itd) represents the absolute value of the inter-channel time difference in the current frame, and N represents the frame length of the current frame.

In Formula (6), a signal with a length of adp_Ts points is manually reconstructed based on the gain modification factor g in the current frame, the transition window in the current frame, and the value of the sampling point (N−adp_Ts) to the value of the sampling point (N−1) on the target sound channel in the current frame, and the value of the sampling point (N−abs(cur_itd)−adp_Ts) to the value of the sampling point (N−abs(cur_itd)−1) on the reference sound channel in the current frame, and the signal with the length of the adp_Ts points is directly used as a value of the sampling point (N−adp_Ts) to a value of the sampling point (N−1) on the target sound channel in the current frame after delay alignment processing.

In this application, the transition segment with the adaptive length is set, and the transition window is determined based on the adaptive length of the transition segment. Compared with a prior-art manner of determining the transition window by using a transition segment with a fixed length, a transition segment signal that can make smoother transition between a real signal on the target sound channel in the current frame and a manually reconstructed signal on the target sound channel in the current frame can be obtained.

According to the method for reconstructing a signal during stereo signal encoding in this embodiment of this application, not only the transition segment signal on the target sound channel in the current frame can be determined, but also a forward signal on the target sound channel in the current frame can be determined. To better describe and understand a manner of determining a forward signal on the target sound channel in the current frame by using the method for reconstructing a signal during stereo encoding in this embodiment of this application, the following first briefly describes a manner of determining a forward signal on the target sound channel in the current frame by using an existing solution.

In the existing solution, the forward signal on the target sound channel in the current frame is usually determined based on the inter-channel time difference in the current frame, the gain modification factor in the current frame, and the reference sound channel signal in the current frame. The gain modification factor is usually determined based on the inter-channel time difference in the current frame, the target sound channel signal in the current frame, and the reference sound channel signal in the current frame.

In the existing solution, the gain modification factor is determined based only on the inter-channel time difference in the current frame, and the target sound channel signal and the reference sound channel signal in the current frame. Consequently, a comparatively large difference exists between a reconstructed forward signal on the target sound channel in the current frame and a real signal on the target sound channel in the current frame. Therefore, a comparatively large difference exists between a primary sound channel signal that is obtained based on the reconstructed forward signal on the target sound channel in the current frame and a primary sound channel signal that is obtained based on the real signal on the target sound channel in the current frame. Consequently, a comparatively large deviation exists between a linear prediction analysis result of a primary sound channel signal obtained during linear prediction and a real linear prediction analysis result. Similarly, there is a comparatively large difference between a secondary sound channel signal that is obtained based on the reconstructed forward signal on the target sound channel in the current frame and a secondary sound channel signal that is obtained based on the real signal on the target sound channel in the current frame. Consequently, a comparatively large deviation exists between a linear prediction analysis result of the secondary sound channel signal obtained during linear prediction and a real linear prediction analysis result.

Figure 4:
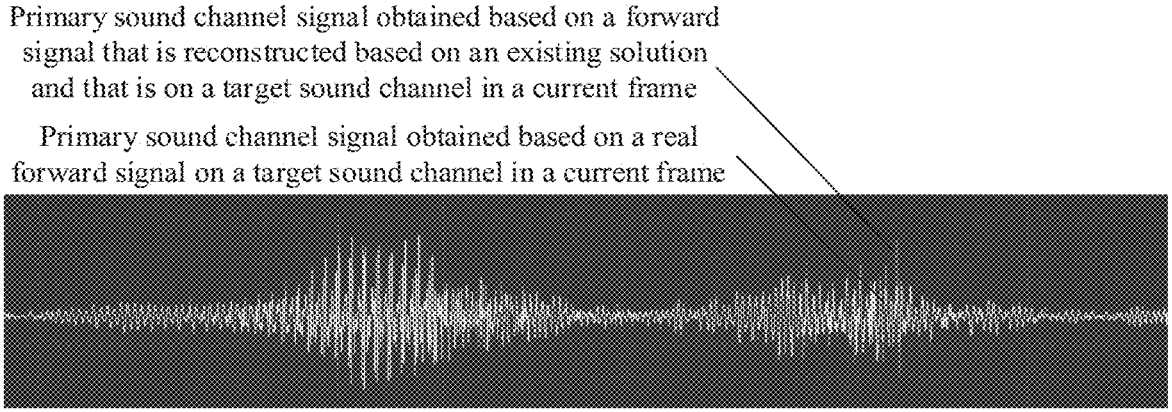
FIG. 4 is a spectral diagram of a primary sound channel signal obtained based on a forward signal that is on a target sound channel and that is obtained according to an existing solution and a primary sound channel signal obtained based on a real signal on the target sound channel.
Figure 5:
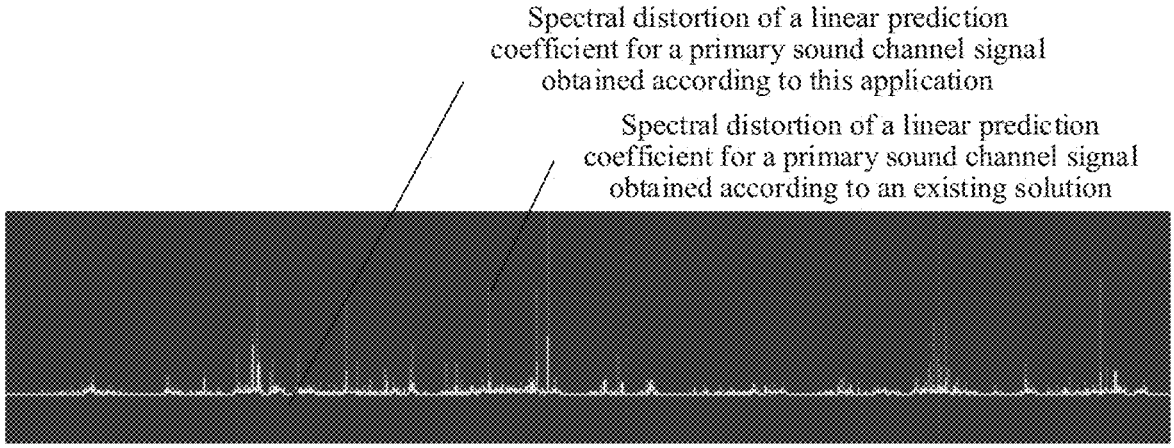
FIG. 5 is a spectral diagram of a difference between a linear prediction coefficient obtained according to an existing solution and a real linear coefficient obtained according this application.

Specifically, as shown in FIG. 4, there is a comparatively large difference between the primary sound channel signal that is obtained based on the prior-art reconstructed forward signal on the target sound channel in the current frame and the primary sound channel signal that is obtained based on the real forward signal on the target sound channel in the current frame. For example, in FIG. 4, the primary sound channel signal that is obtained based on the prior-art reconstructed forward signal on the target sound channel in the current frame is generally greater than the primary sound channel signal that is obtained based on the real forward signal on the target sound channel in the current frame.

Optionally, the gain modification factor of the reconstructed signal in the current frame may be determined in any one of the following Manner 1 to Manner 3.

Manner 1: An initial gain modification factor is determined based on the transition window in the current frame, the adaptive length of the transition segment in the current frame, the target sound channel signal in the current frame, the reference sound channel signal in the current frame, and the inter-channel time difference in the current frame, where the initial gain modification factor is the gain modification factor in the current frame.

In this application, when the gain modification factor is determined, in addition to the inter-channel time difference in the current frame, the target sound channel signal and the reference sound channel signal in the current frame, the adaptive length of the transition segment in the current frame and the transition window in the current frame are further considered. In addition, the transition window in the current frame is determined based on the transition segment with the adaptive length. Compared with an existing solution in which the gain modification factor is determined based only on the inter-channel time difference in the current frame, the target sound channel signal in the current frame, and the reference sound channel signal in the current frame, energy consistency between a real signal on the target sound channel in the current frame and a reconstructed forward signal on the target sound channel the current frame is considered. Therefore, the obtained forward signal on the target sound channel in the current frame is more approximate to a real forward signal on the target sound channel in the current frame, that is, the reconstructed forward signal in this application is more accurate than that in the existing solution.

Optionally, in Manner 1, when average energy of a reconstructed signal on the target sound channel is consistent with average energy of a real signal on the target sound channel, Formula (7) is met:

$$\frac{K}{T_d - T_0}\sum_{i=T_0}^{T_d-1} x^2(i) = \frac{1}{N - T_0}\left[\sum_{i=T_0}^{T_s-1} x^2(i + \text{abs(cur_itd)}) + \sum_{i=T_s}^{T_d-1} [[1 - w(i - T_s)] \cdot x(i + \text{abs(cur_itd)}) + w(i - T_s) \cdot g \cdot y(i)]^2 + \sum_{i=T_d}^{N-1} g^2 \cdot y^2(i)\right] \quad (7)$$

In Formula (7), K represents an energy attenuation coefficient, K is a preset real number, $0<K\leq 1$, and a value of K may be set by a skilled person by experience, where for example, K is 0.5, 0.75, 1, or the like; g represents the gain modification factor in the current frame; w(.) represents the transition window in the current frame; x(.) represents the target sound channel signal in the current frame; y(.) represents the reference sound channel signal in the current frame; N represents the frame length of the current frame; $T_s$ represents a sampling point index that is of the target sound channel and that corresponds to a start sampling point index of the transition window; $T_d$ represents a sampling point index that is of the target sound channel and that corresponds to an end sampling point index of the transition window $T_s$=N−abs(cur_itd)−adp_Ts, $T_d$=N−abs(cur_itd), $T_0$ represents a preset start sampling point index that is of the target sound channel and that is used to calculate the gain modification factor, and $0\leq T_0<T_s$; cur_itd represents the inter-channel time difference in the current frame; abs(cur_itd) represents the absolute value of the inter-channel time difference in the current frame; and adp_Ts represents the adaptive length of the transition segment in the current frame.

Specifically, w(i) is a value of the transition window in the current frame at a sampling point i, x(i) is a value of the target sound channel signal in the current frame at the sampling point i, and y(i) is a value of the reference sound channel signal in the current frame at the sampling point i.

Further, to make the average energy of the reconstructed signal on the target sound channel be consistent with the average energy of the real signal on the target sound channel, that is, an average energy of the reconstructed forward signal and the transition segment signal that are on the target sound channel is consistent with the average energy of the real signal on the target sound channel, as expressed in Formula (7). Therefore, it may be deduced that the initial gain modification factor satisfies Formula (8):

$$g = \frac{-b + \sqrt{b^2 - 4ac}}{2a} \quad (8)$$

a, b, and c in Formula respectively satisfy the following Formula (9) to Formula (11):

$$a = \frac{1}{N - T_0}\sum_{i=T_d}^{N-1} y^2(i) + \left[\sum_{i=T_s}^{T_d-1} w(i - T_s) \cdot y(i)\right]^2 \quad (9)$$

$$b = \frac{2}{N - T_0}\sum_{i=T_s}^{T_d-1} [1 - w(i - T_s)] \cdot x(i + \text{abs(cur_itd)}) \cdot w(i - T_s) \cdot y(i) \quad (10)$$

$$c = \frac{1}{N - T_0}\left[\sum_{i=T_0}^{T_s-1} x^2(i + \text{abs (cur_itd)}) + \sum_{i=T_s}^{T_d-1} [[1 - w(i - T_s)]x(i + \text{abs (cur_itd)})]^2\right] - \frac{K}{T_d - T_0}\sum_{i=T_0}^{T_d-1} x^2(i) \quad (11)$$

Manner 2: An initial gain modification factor is determined based on the transition window in the current frame, the adaptive length of the transition segment in the current frame, the target sound channel signal in the current frame, the reference sound channel signal in the current frame, and the inter-channel time difference in the current frame; and the initial gain modification factor is modified based on a first modification coefficient to obtain the gain modification factor in the current frame, where the first modification coefficient is a preset real number greater than 0 and less than 1.

The first modification coefficient is a preset real number greater than 0 and less than 1.

The gain modification factor is modified by using the first modification coefficient, so that energy of the finally obtained transition segment signal and forward signal in the current frame can be appropriately reduced, and impact made, on a linear prediction analysis result obtained by using a mono coding algorithm during stereo encoding, by a difference between a manually reconstructed forward signal on the target sound channel and a real forward signal on the target sound channel can be further reduced.

Specifically, the gain modification factor may be modified according to Formula (12).

$$g_mod = adj_fac * g \quad (12)$$

g represents the calculated gain modification factor, g_mod represents a modified gain modification factor, and adj_fac represents the first modification coefficient, where adj_fac may be preset by a skilled person by experience, adj_fac is generally a positive number greater than zero and less than 1, for example, adj_fac=0.5 and adj_fac=0.25.

Manner 3: An initial gain modification factor is determined based on the inter-channel time difference in the current frame, the target sound channel signal in the current frame, and the reference sound channel signal in the current frame; and the initial gain modification factor is modified based on a second modification coefficient to obtain the gain modification factor in the current frame, where the second modification coefficient is a preset real number greater than 0 and less than 1 or is determined according to a preset algorithm.

The second modification coefficient is a preset real number greater than 0 and less than 1. For example, the second modification coefficient is 0.5, 0.8, or the like.

The gain modification factor is modified by using the second modification coefficient, so that the finally obtained transition segment signal and forward signal in the current frame can be more accurate, and impact made, on a linear prediction analysis result obtained by using a mono coding algorithm during stereo encoding, by a difference between a manually reconstructed forward signal on the target sound channel and a real forward signal on the target sound channel can be reduced.

In addition, when the second modification coefficient is determined according to the preset algorithm, the second modification coefficient may be determined based on the reference sound channel signal and the target sound channel signal in the current frame, the inter-channel time difference in the current frame, the adaptive length of the transition segment in the current frame, the transition window in the current frame, and the gain modification factor in the current frame.

Specifically, when the second modification coefficient is determined based on the reference sound channel signal and the target sound channel signal in the current frame, the inter-channel time difference in the current frame, the adaptive length of the transition segment in the current frame, the transition window in the current frame, and the gain modification factor in the current frame, the second modification coefficient may satisfy the following Formula (13) or Formula (14). In other words, the second modification coefficient may be determined according to Formula (13) or Formula (14):

$$\text{adj_fac} = \frac{\frac{K}{T_d - T_0}\sum_{i=T_0}^{T_d-1} x^2(i)}{\frac{1}{N-T_s}\left[\sum_{i=T_s}^{T_d-1}[[1-w(i-T_s)]\cdot x(i+\text{abs(cur_itd)}) + w(i-T_s)\cdot g\cdot y(i)]^2 + \sum_{i=T_d}^{N-1} g^2\cdot y^2(i)\right]} \tag{13}$$

$$\text{adj_fac} = \frac{\frac{K}{T_d - T_0}\sum_{i=T_0}^{T_d-1} x^2(i)}{\frac{1}{N-T_0}\left[\sum_{i=T_0}^{T_b-1} x^2(i+\text{abs(cur_itd)}) + \sum_{i=T_b}^{T_d-1}[[1-w(i-T_s)]\cdot x(i+\text{abs(cur_itd)}) + w(i-T_s)\cdot g\cdot y(i)]^2 + \sum_{i=T_d}^{N-1} g^2\cdot y^2(i)\right]} \tag{14}$$

adj_fac represents the second modification coefficient; K represents the energy attenuation coefficient, K is a preset real number, $0<K\leq 1$, and a value of K may be set by a skilled person by experience, for example, K is 0.5, 0.75, 1, or the like; g represents the gain modification factor in the current frame; w(.) represents the transition window in the current frame; x(.) represents the target sound channel signal in the current frame; y(.) represents the reference sound channel signal in the current frame; N represents the frame length of the current frame; $T_s$ represents a sampling point index of the target sound channel corresponding to a start sampling point index of the transition window, $T_d$ represents a sampling point index of the target sound channel corresponding to an end sampling point index of the transition window, $T_s$=N−abs(cur_itd)−adp_Ts, $T_d$=N−abs(cur_itd), $T_0$ represents a preset start sampling point index of the target sound channel used to calculate the gain modification factor, and $0\leq T_0<T_s$; cur_itd represents the inter-channel time difference in the current frame, abs(cur_itd) represents the absolute value of the inter-channel time difference in the current frame; and adp_Ts represents the adaptive length of the transition segment in the current frame.

Specifically, $w(i-T_s)$ is a value of the transition window in the current frame at a sampling point $(i-T_s)$, x(i+abs(cur_itd)) is a value of the target sound channel signal in the current frame at the sampling point (i+abs(cur_itd)), x(i) is a value of the target sound channel signal in the current frame at the sampling point i, and y(i) is a value of the reference sound channel signal in the current frame at the sampling point i.

Optionally, in an embodiment, the method 300 further includes: determining a forward signal on the target sound channel in the current frame based on the inter-channel time difference in the current frame, the gain modification factor in the current frame, and the reference sound channel signal in the current frame.

It should be understood that the gain modification factor in the current frame may be determined in any one of the following Manner 1 to Manner 3.

Specifically, when the forward signal on the target sound channel in the current frame is determined based on the inter-channel time difference in the current frame, the gain modification factor in the current frame, and the reference sound channel signal in the current frame, the forward signal on the target sound channel in the current frame may satisfy Formula (15). Therefore, the forward signal on the target sound channel in the current frame may be determined according to Formula (15):

$$\text{reconstruction_seg}(i)=g*\text{reference}(N-\text{abs(cur_itd)}+i),\quad \text{where } i=0,1,\ldots,\text{abs(cur_itd)}-1 \tag{15}$$

reconstruction_seg(.) represents the forward signal on the target sound channel in the current frame, reference(.) represents the reference sound channel signal in the current frame, g represents the gain modification factor in the current frame, cur_itd represents the inter-channel time difference in the current frame, abs(cur_itd) represents the absolute value of the inter-channel time difference in the current frame, and N represents the frame length of the current frame.

Specifically, reconstruction_seg(i) is a value of the forward signal on the target sound channel in the current frame at a sampling point i, and reference(N−abs(cur_itd)+i) is a value of the reference sound channel signal in the current frame at a sampling point (N−abs(cur_itd)+1).

In other words, in Formula (15), a product of a value of the reference sound channel signal in the current frame from a sampling point (N−abs(cur_itd)) to a sampling point (N−1) and the gain modification factor g is used as a signal of the forward signal on the target sound channel in the current frame from a sampling point 0 to a sampling point (abs(cur_itd)−1). Next, the signal from the sampling point 0 to the sampling point (abs(cur_itd)−1) of the forward signal on the target sound channel in the current frame is used as a signal from a point N to a point (N+abs(cur_itd)−1) on the target sound channel after delay alignment processing.

It should be understood that Formula (15) may be transformed to obtain Formula (16).

$$\text{target_alig}(N+i)=g*\text{reference}(N-\text{abs(cur_itd)}+i) \tag{16}$$

In Formula (16), target_alig(N+i) represents a value of a sampling point (N+i) on the target sound channel after delay alignment processing. According to Formula (16), the product of the value of the reference sound channel signal in the current frame from the sampling point (N−abs(cur_itd)) to the sampling point (N−1) and the gain modification factor g may be directly used as the signal from the point N to the point (N+abs(cur_itd)−1) on the target sound channel after delay alignment processing.

Specifically, when the gain modification factor in the current frame is determined in Manner 2 or Manner 3, the forward signal on the target sound channel in the current frame may satisfy Formula (17). In other words, the forward signal on the target sound channel in the current frame may be determined according to Formula (17).

$$\text{reconstruction_seg}(i)=g_\text{mod}*\text{reference}(N-\text{abs}(\text{cur_itd})+i) \quad (17)$$

reconstruction_seg(.) represents the forward signal on the target sound channel in the current frame, g_mod represents the gain modification factor in the current frame that is obtained by modifying the initial gain modification factor by using the first modification coefficient or the second modification coefficient, reference(.) represents the reference sound channel signal in the current frame, cur_itd represents the inter-channel time difference in the current frame, abs (cur_itd) represents the absolute value of the inter-channel time difference in the current frame, N represents the frame length of the current frame, and i=0, 1, . . . , abs(cur_itd)−1.

Specifically, reconstruction_seg(i) is a value of the forward signal on the target sound channel in the current frame at the sampling point i, and reference(N−abs(cur_itd)+i) is a value of the reference sound channel signal in the current frame at the sampling point (N−abs(cur_itd)+i).

In other words, in Formula (17), a product of the value of the reference sound channel signal in the current frame from the sampling point (N−abs(cur_itd)) to the sampling point (N−1) and g_mod is used as a signal of the forward signal on the target sound channel in the current frame from the sampling point 0 to the sampling point (abs(cur_itd)−1). Next, the signal of the forward signal from the sampling point 0 to the sampling point (abs(cur_itd)−1) on the target sound channel in the current frame is used as a signal from the point 0 to the point (N+abs(cur_itd)−1) on the target sound channel after delay alignment processing.

It should be understood that Formula (17) may be further transformed to obtain Formula (18).

$$\text{target_alig}(N+i)=g_\text{mod}*\text{reference}(N-\text{abs}(\text{cur_itd})+i) \quad (18)$$

In Formula (18), target_alig(N+i) represents a value of a sampling point (N+i) on the target sound channel after delay alignment processing. According to Formula (18), the product of the value of the reference sound channel signal in the current frame from the sampling point (N−abs(cur_itd)) to the sampling point (N−1) and the modified gain modification factor g_mod may be directly used as the signal from the point N to the point (N+abs(cur_itd)−1) on the target sound channel after delay alignment processing.

When the gain modification factor in the current frame is determined in Manner 2 or Manner 3, the transition segment signal on the target sound channel in the current frame may satisfy Formula (19). In other words, the transition segment signal on the target sound channel in the current frame may be determined according to Formula (19).

$$\text{transition_seg}(i)=w(i)*g_\text{mod}*\text{reference}(N-\text{adp_Ts}-\text{abs}(\text{cur_itd})+i)+(1-w(i))*\text{target}(N-\text{adp_Ts}+i),\ \text{where } i=0,1,\ldots,\text{adp_Ts}-1 \quad (19)$$

In Formula (19), transition_seg(i) is a value of the transition segment signal on the target sound channel in the current frame at the sampling point i, w(i) is a value of the transition window in the current frame at the sampling point i, reference(N−abs(cur_itd)+i) is a value of the reference sound channel signal in the current frame at the sampling point (N−abs(cur_itd)+i), adp_Ts represents the adaptive length of the transition segment in the current frame, g_mod represents the gain modification factor in the current frame that is obtained by modifying the initial gain modification factor by using the first modification coefficient or the second modification coefficient, cur_itd represents the inter-channel time difference in the current frame, abs(cur_itd) represents the absolute value of the inter-channel time difference in the current frame, and N represents the frame length of the current frame.

In other words, in Formula (19), a signal with a length of adp_Ts points is manually reconstructed based on g_mod, values from a point 0 to a point (adp_Ts−1) of the transition window in the current frame, values from a sampling point (N−abs(cur_itd)−adp_Ts) to a sampling point (N−abs(cur_itd)−1) on the reference sound channel in the current frame, and values from a sampling point (N−adp_Ts) to a sampling point (N−1) on the target sound channel in the current frame, and the manually reconstructed signal with the length of the adp_Ts points is determined as a signal from the point 0 to the point (adp_Ts−1) of the transition segment signal on the target sound channel in the current frame. Further, after the transition segment signal in the current frame is determined, the value of the sampling point 0 to the value of the sampling point (adp_Ts−1) of the transition segment signal on the target sound channel in the current frame may be used as a value of the sampling point (N−adp_Ts) to a value of the sampling point (N−1) on the target sound channel after delay alignment processing.

It should be understood that Formula (19) may be transformed to obtain Formula (20).

$$\text{target_alig}(N-\text{adp_Ts}+i)=w(i)*g_\text{mod}*\text{reference}(N-\text{adp_Ts}-\text{abs}(\text{cur_itd})+i)+(1-w(i))*\text{target}(N-\text{adp_Ts}+i),\ \text{where } i=0,1,\ldots,\text{adp_Ts}-1 \quad (20)$$

In Formula (20), target_alig(N−adp_Ts+i) is a value of a sampling point (N−adp_Ts+i) on the target sound channel in the current frame after delay alignment processing. In Formula (20), a signal with a length of adp_Ts points is manually reconstructed based on the modified gain modification factor, the transition window in the current frame, and the value of the sampling point (N−adp_Ts) to the value of the sampling point (N−1) on the target sound channel in the current frame, and the value of the sampling point (N−abs (cur_itd)−adp_Ts) to the value of the sampling point (N−abs (cur_itd)−1) on the reference sound channel in the current frame, and the signal with the length of the adp_Ts points is directly used as a value of the sampling point (N−adp_Ts) to a value of the sampling point (N−1) on the target sound channel in the current frame after delay alignment processing.

Figure 6:
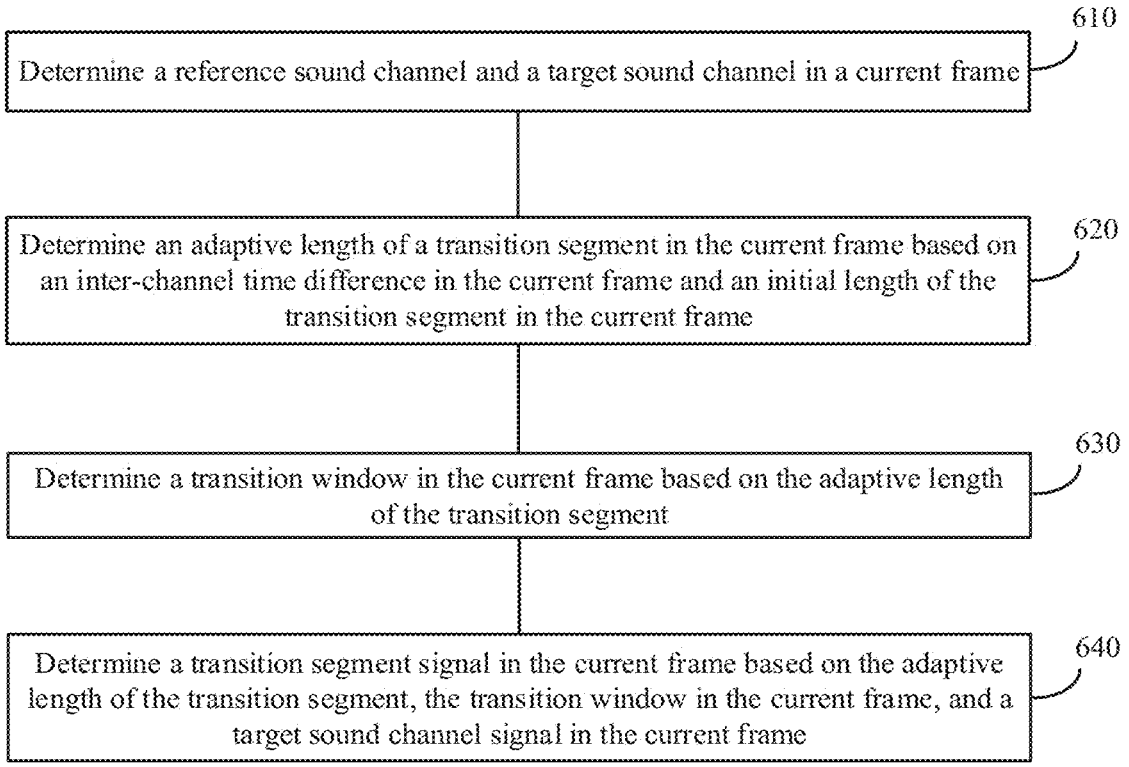
FIG. 6 is a schematic flowchart of a method for reconstructing a signal during stereo signal encoding according to an embodiment of this application.

The foregoing describes the method for reconstructing a signal during stereo signal encoding in this embodiment of this application in detail with reference to FIG. 3. In the foregoing method 300, the gain modification factor g is used to determine the transition segment signal. Actually, in some cases, to reduce calculation complexity, the gain modification factor g may be directly set to zero when the transition segment signal on the target sound channel in the current frame is determined, or the gain modification factor g is not used or is used when the transition segment signal of the target sound channel in the current frame is determined. With reference to FIG. 6, the following describes a method for determining a transition segment signal on a target sound channel in a current frame without using a gain modification factor.

FIG. 6 is a schematic flowchart of a method for reconstructing a signal during stereo signal encoding according to an embodiment of this application. The method 600 may be performed by an encoder side. The encoder side may be an encoder or a device with a stereo signal encoding function. The method 600 specifically includes the following steps.

610. Determine a reference sound channel and a target sound channel in a current frame.

Optionally, when the reference sound channel and the target sound channel in the current frame are determined, a sound channel with a later arrival time may be determined as the target sound channel, and the other sound channel with an earlier arrival time is determined as the reference sound channel. For example, if an arrival time of a left sound channel lags behind an arrival time of a right sound channel, the left sound channel may be determined as the target sound channel, and the right sound channel may be determined as the reference sound channel.

Optionally, the reference sound channel and the target sound channel in the current frame may be determined based on an inter-channel time difference in the current frame. Specifically, the target sound channel and the reference sound channel in the current frame may be determined in the manners in Case 1 to Case 3 following step 310.

620. Determine an adaptive length of a transition segment in the current frame based on the inter-channel time difference in the current frame and an initial length of the transition segment in the current frame.

Optionally, when an absolute value of the inter-channel time difference in the current frame is greater than or equal to the initial length of the transition segment in the current frame, the initial length of the transition segment in the current frame is determined as the adaptive length of the transition segment in the current frame; or when an absolute value of the inter-channel time difference in the current frame is less than the initial length of the transition segment in the current frame, the absolute value of the inter-channel time difference in the current frame is determined as the adaptive length of the transition segment.

When the absolute value of the inter-channel time difference in the current frame is less than the initial length of the transition segment in the current frame, depending on a result of comparison between the inter-channel time difference in the current frame and the initial length of the transition segment in the current frame, a length of the transition segment can be appropriately reduced, the adaptive length of the transition segment in the current frame is appropriately determined, and further a transition window with the adaptive length is determined. In this way, transition between a real signal and a manually reconstructed forward signal on the target sound channel in the current frame is smoother.

The adaptive length of the transition segment in the current frame can be appropriately determined depending on a result of comparison between the inter-channel time difference in the current frame and the initial length of the transition segment in the current frame, and further the transition window with the adaptive length is determined. In this way, transition between the real signal on the target sound channel in the current frame and the manually reconstructed forward signal is smoother. Specifically, the adaptive length of the transition segment determined in step 620 satisfies the following Formula (21). Therefore, the adaptive length of the transition segment may be determined according to Formula (21).

$$\text{adp_Ts} = \begin{cases} Ts\ 2, & \text{abs(cur_itd)} \geq Ts\ 2 \\ \text{abs(cur_itd)}, & \text{abs(cur_itd)} < Ts\ 2 \end{cases} \tag{21}$$

cur_itd represents the inter-channel time difference in the current frame, abs(cur_itd) represents the absolute value of the inter-channel time difference in the current frame, and Ts2 represents the preset initial length of the transition segment, where the initial length of the transition segment may be a preset positive integer. For example, when a sampling rate is 16 kHz, Ts2 is set to 10.

In addition, with regard to different sampling rates, Ts2 may be set to a same value or different values.

It should be understood that the inter-channel time difference in the current frame in step 620 may be obtained by estimating the inter-channel time difference a left sound channel signal and a right sound channel signal.

When the inter-channel time difference is estimated, a cross-correlation coefficient between a left sound channel and a right sound channel may be calculated based on the left sound channel signal and the right sound channel signal in the current frame, and then an index value corresponding to a maximum value of the cross-correlation coefficient is used as the inter-channel time difference in the current frame.

Specifically, the inter-channel time difference may be estimated in the manners in Example 1 to Example 3 following step 320.

630. Determine the transition window in the current frame based on the adaptive length of the transition segment.

Optionally, the transition window in the current frame may be determined according to Formulas (2), (3), or (4) following step 330.

640. Determine a transition segment signal in the current frame based on the adaptive length of the transition segment, the transition window in the current frame, and a target sound channel signal in the current frame.

In this application, the transition segment with the adaptive length is set, and the transition window is determined based on the adaptive length of the transition segment. Compared with a prior-art manner of determining the transition window by using a transition segment with a fixed length, a transition segment signal that can make smoother transition between a real signal on the target sound channel in the current frame and a manually reconstructed signal on the target sound channel in the current frame can be obtained.

The transition segment signal on the target sound channel in the current frame satisfies Formula (22):

$$\text{transition_seg}(i)=(1-w(i)*\text{target}(N-\text{adp_Ts}+i),\ \text{where}\ i=0,1,\ldots,\text{adp_Ts}-1 \tag{22}$$

transition_seg(.) represents the transition segment signal on the target sound channel in the current frame, adp_Ts represents the adaptive length of the transition segment in the current frame, w(.) represents the transition window in the current frame, target(.) represents the target sound channel signal in the current frame, cur_itd represents the inter-channel time difference in the current frame, abs(cur_itd) represents the absolute value of the inter-channel time difference in the current frame, N represents a frame length of the current frame, and i=0, 1, . . . , adp_Ts−1.

Specifically, transition_seg(i) is a value of the transition segment signal on the target sound channel in the current frame at a sampling point i, w(i) is a value of the transition window in the current frame at the sampling point i, and target(N−adp_Ts+i) is a value of the target sound channel signal in the current frame at a sampling point (N−adp_Ts+i).

Optionally, the method 600 further includes: setting a forward signal on the target sound channel in the current frame to zero.

Specifically, the forward signal on the target sound channel in the current frame satisfies Formula (23):

$$\text{target_alig}(N+i)=0,\ \text{where } i=0,1,\ldots,\text{adp_Ts}+\text{abs}(\text{cur_itd})-1 \tag{23}$$

In Formula (23), a value from a sampling point N to a sampling point (N+abs(cur_itd)−1) on the target sound channel in the current frame is 0. It should be understood that a signal from the sampling point N to the sampling point (N+abs(cur_itd)−1) on the target sound channel in the current frame is the forward signal of the target sound channel signal in the current frame.

The forward signal on the target sound channel is set to zero, so that calculation complexity can be further reduced.

The following describes a method for reconstructing a signal during stereo signal encoding in the embodiments of this application in detail with reference to FIG. 7 to FIG. 12.

Figure 7:
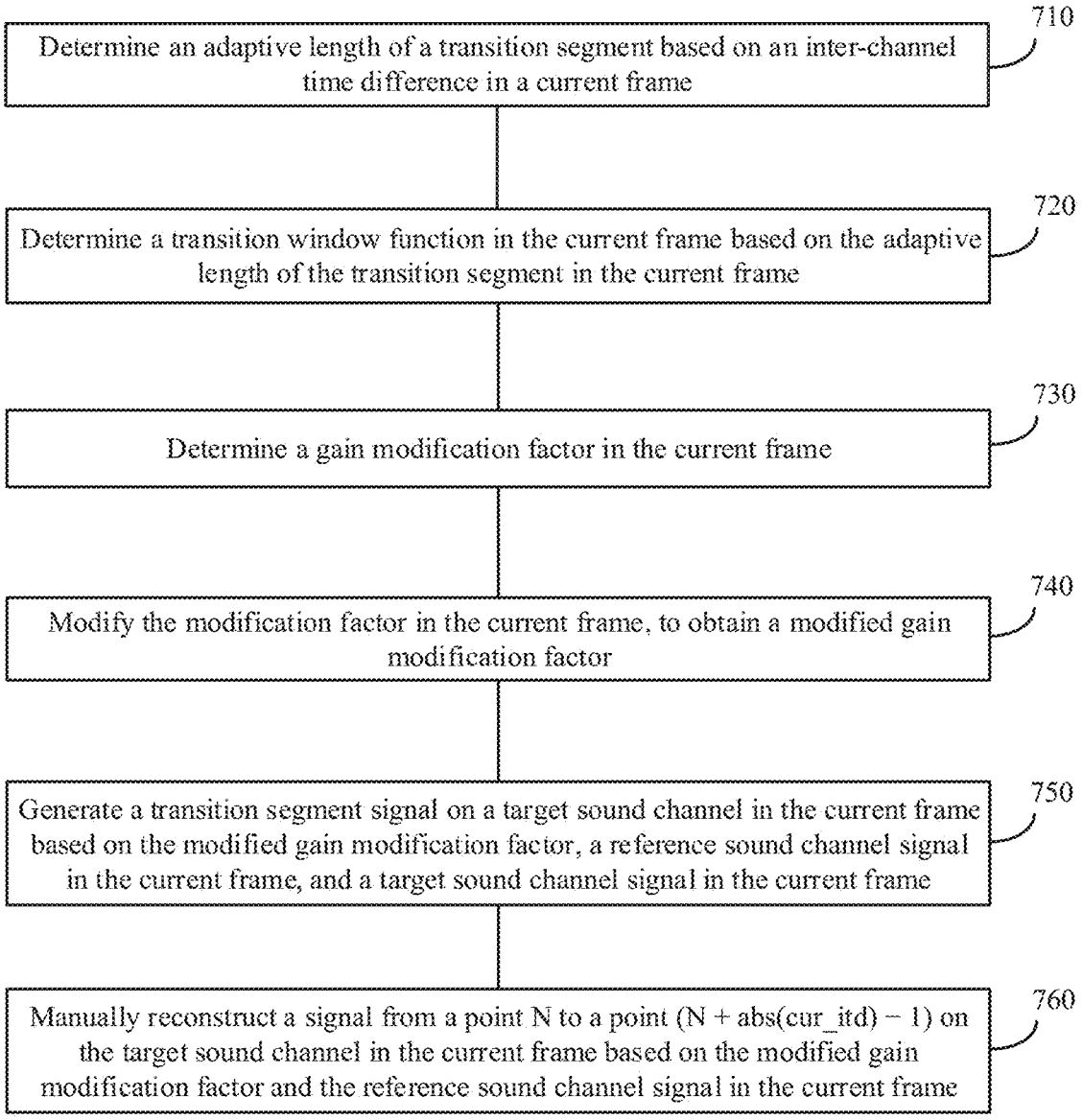
FIG. 7 is a schematic flowchart of a method for reconstructing a signal during stereo signal encoding according to an embodiment of this application.

FIG. 7 is a schematic flowchart of a method for reconstructing a signal during stereo signal encoding according to an embodiment of this application. The method 700 specifically includes the following steps.

710. Determine an adaptive length of a transition segment based on an inter-channel time difference in a current frame.

Before step 710, a target sound channel signal in the current frame and a reference sound channel signal in the current frame need to be obtained first, and then a time difference between the target sound channel signal in the current frame and the reference sound channel signal in the current frame is estimated, to obtain the inter-channel time difference in the current frame.

720. Determine a transition window function in the current frame based on the adaptive length of the transition segment in the current frame.

730. Determine a gain modification factor in the current frame.

In step 730, the gain modification factor may be determined in an existing manner (based on the inter-channel time difference in the current frame, the target sound channel signal in the current frame, and the reference sound channel signal in the current frame), or the gain modification factor may be determined in a manner according to this application (based on the transition window in the current frame, a frame length of the current frame, the target sound channel signal in the current frame, the reference sound channel signal in the current frame, and the inter-channel time difference in the current frame).

740. Modify the gain modification factor in the current frame, to obtain a modified gain modification factor.

When the gain modification factor is determined in the existing manner in step 730, the gain modification factor may be modified by using the foregoing second modification coefficient. When the gain modification factor is determined in the manner according to this application in step 730, the gain modification factor may be modified by using the foregoing second modification coefficient, or the gain modification factor may be modified by using the foregoing first modification coefficient.

750. Generate a transition segment signal on the target sound channel in the current frame based on the modified gain modification factor, the reference sound channel signal in the current frame, and the target sound channel signal in the current frame.

760. Manually reconstruct a signal from a point N to a point (N+abs(cur_itd)−1) on the target sound channel in the current frame based on the modified gain modification factor and the reference sound channel signal in the current frame.

In step 760, manually reconstructing the signal from the point N to the point (N−abs(cur_itd)−1) on the target sound channel in the current frame means reconstructing a forward signal on the target sound channel in the current frame.

After the gain modification factor g is calculated, the gain modification factor is modified by using a modification coefficient, so that energy of the manually reconstructed forward signal can be reduced, impact made, on a linear prediction analysis result obtained by using a mono coding algorithm during stereo encoding, by a difference between a manually reconstructed forward signal and a real forward signal can be reduced, and accuracy of linear prediction analysis can be improved.

Optionally, to further reduce the impact made, on the linear prediction analysis result obtained by using the mono coding algorithm during stereo encoding, by the difference between the manually reconstructed forward signal and the real forward signal, gain modification may also be performed on a sampling point of the manually reconstructed signal based on an adaptive modification coefficient.

Specifically, the transition segment signal on the target sound channel in the current frame is first determined (generated) based on the inter-channel time difference in the current frame, the adaptive length of the transition segment in the current frame, the transition window in the current frame, the gain modification factor in the current frame, the reference sound channel signal in the current frame, and the target sound channel signal in the current frame. The forward signal on the target sound channel in the current frame is determined (generated) based on the inter-channel time difference in the current frame, the gain modification factor in the current frame, and the reference sound channel signal in the current frame. The forward signal is used as a signal from a point (N−adp_Ts) to a point (N−abs(cur_itd)−1) of a target sound channel signal target_alig obtained after delay alignment processing.

The adaptive modification coefficient is determined according to Formula (24):

$$\text{adj_fac}(i)=\cos\left(i*\frac{\pi}{2*(\text{adp_Ts}+\text{abs}(\text{cur_itd}))}\right),\quad \text{where } i=0,1,\ldots,\text{adp_Ts}+\text{abs}(\text{cru_itd})-1 \tag{24}$$

adp_Ts represents the adaptive length of the transition segment, cur_itd represents the inter-channel time difference in the current frame, and abs (cur_itd) represents an absolute value of the inter-channel time difference in the current frame.

After the adaptive modification coefficient adj_fac(i) is obtained, adaptive gain modification may be performed on the signal from the point (N−adp_Ts) to the point (N+abs(cur_itd)−1) on the target sound channel after delay alignment processing based on the adaptive modification coefficient adj_fac(i), to obtain a modified target sound channel signal obtained after delay alignment processing, as shown in Formula (25):

$$\text{target_alig_mod}(i) = \begin{cases} \text{target_alig}(i), & i = 0, 1, L, N - \text{adp_Ts} - 1 \\ \text{adj_fac}(i - (N - \text{adp_Ts})) * \text{target_alig}(i), & i = N - \text{adp_Ts}, L, N + \text{abs}(\text{cur_itd}) - 1 \end{cases} \quad (25)$$

adj_fac(i) represents the adaptive modification coefficient, target_alig_mod(i) represents the modified target sound channel signal obtained after delay alignment processing, target_alig(i) represents the target sound channel signal obtained after delay alignment processing, cur_itd represents the inter-channel time difference in the current frame, abs(cur_itd) represents the absolute value of the inter-channel time difference in the current frame, N represents the frame length of the current frame, and adp_Ts represents the adaptive length of the transition segment in the current frame.

Gain modification is performed on the transition segment signal and a sampling point of the manually reconstructed forward signal by using the adaptive modification coefficient, so that the impact made by the difference between the manually reconstructed forward signal and the real forward signal can be reduced.

Figure 8:
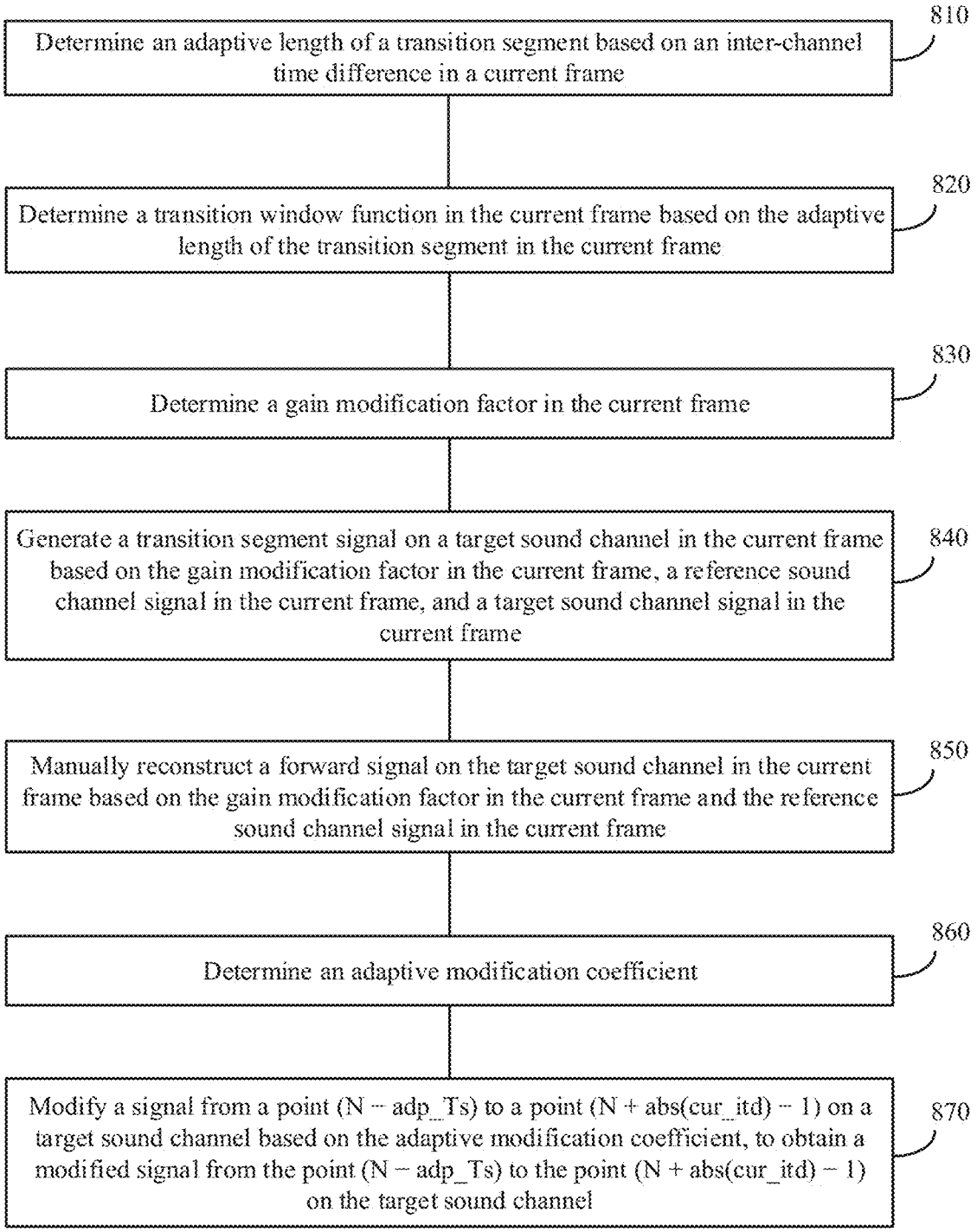
FIG. 8 is a schematic flowchart of a method for reconstructing a signal during stereo signal encoding according to an embodiment of this application.
Figure 9:
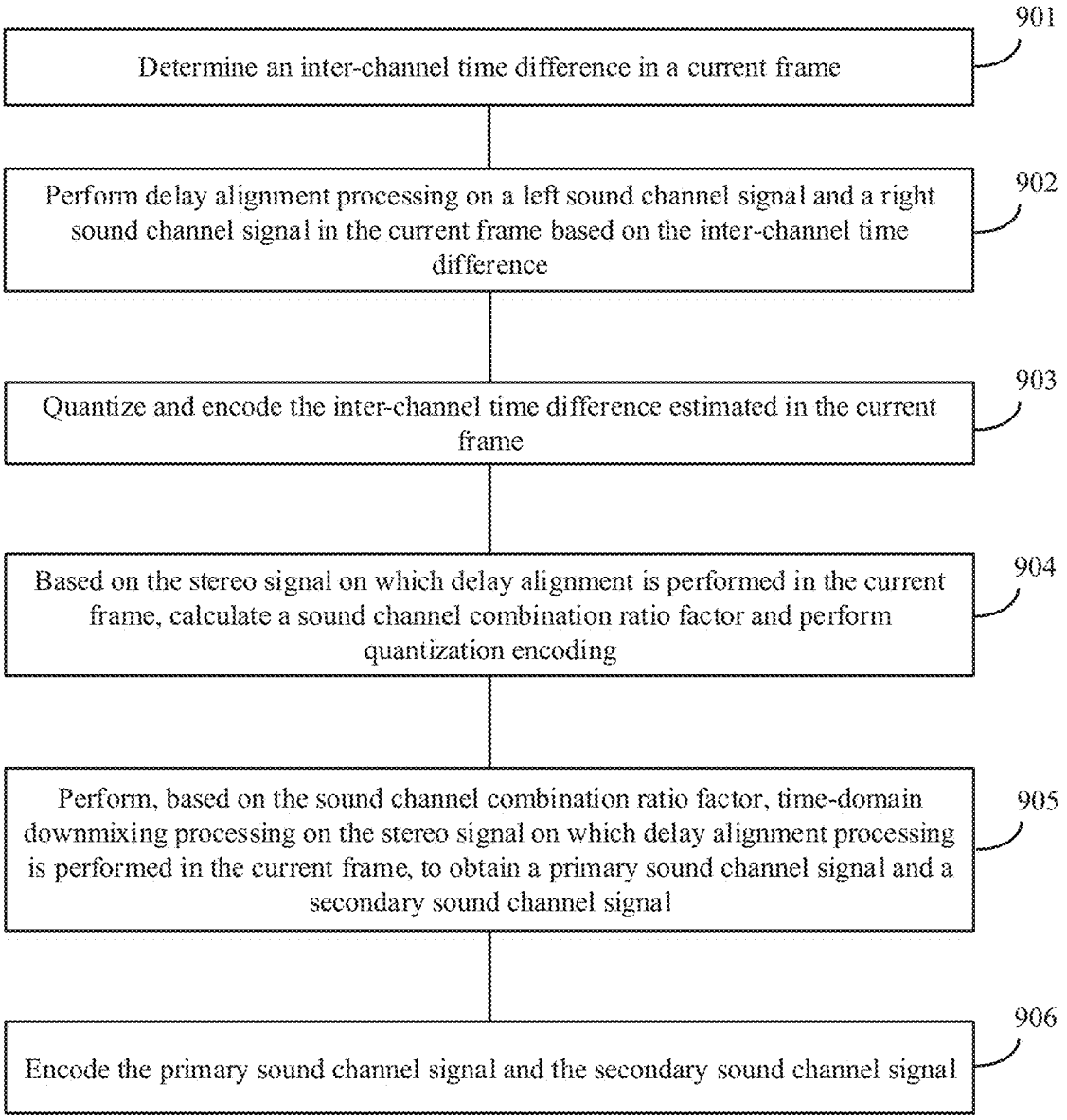
FIG. 9 is a schematic flowchart of a method for reconstructing a signal during stereo signal encoding according to an embodiment of this application.

Optionally, when gain modification is performed on the sampling point of the manually reconstructed forward signal by using the adaptive modification coefficient, a specific process of generating the transition segment signal and the forward signal on the target sound channel in the current frame may be shown in FIG. 8.

810. Determine an adaptive length of a transition segment based on an inter-channel time difference in a current frame.

Before step 810, a target sound channel signal in the current frame and a reference sound channel signal in the current frame need to be obtained first, and then a time difference between the target sound channel signal in the current frame and the reference sound channel signal in the current frame is estimated, to obtain the inter-channel time difference in the current frame.

820. Determine a transition window in the current frame based on the adaptive length of the transition segment in the current frame.

830. Determine a gain modification factor in the current frame.

In step 830, the gain modification factor may be determined in an existing manner (based on the inter-channel time difference in the current frame, the target sound channel signal in the current frame, and the reference sound channel signal in the current frame), or the gain modification factor may be determined in a manner according to this application (based on the transition window in the current frame, a frame length of the current frame, the target sound channel signal in the current frame, the reference sound channel signal in the current frame, and the inter-channel time difference in the current frame).

840. Generate a transition segment signal on the target sound channel in the current frame based on the gain modification factor in the current frame, the reference sound channel signal in the current frame, and the target sound channel signal in the current frame.

850. Manually reconstruct a forward signal on the target sound channel in the current frame based on the gain modification factor in the current frame and the reference sound channel signal in the current frame.

860. Determine an adaptive modification coefficient.

The adaptive modification coefficient may be determined according to Formula (24).

870. Modify a signal from a point (N−adp_Ts) to a point (N+abs(cur_itd)−1) on a target sound channel based on the adaptive modification coefficient, to obtain a modified signal from the point (N−adp_Ts) to the point (N+abs(cur_itd)−1) on the target sound channel.

The modified signal, obtained in step 870, from the point (N−adp_Ts) to the point (N+abs(cur_itd)−1) on the target sound channel is a modified transition segment signal on the target sound channel in the current frame and a modified forward signal on the target sound channel in the current frame.

In this application, to further reduce impact made by a difference between a manually reconstructed forward signal and a real forward signal on a linear prediction analysis result obtained by using a mono coding algorithm during stereo encoding, the gain modification factor may be modified after the gain modification factor is determined, or the transition segment signal and the forward signal on the target sound channel in the current frame may be modified after the transition segment signal and the forward signal on the target sound channel in the current frame are generated. This can both make a finally obtained forward signal more accurate, and further reduce the impact made by the difference between the manually reconstructed forward signal and the real forward signal on the linear prediction analysis result obtained by using the mono coding algorithm in stereo encoding.

It should be understood that, in this embodiment of this application, after the transition segment signal and the forward signal on the target sound channel in the current frame are generated, to encode a stereo signal, a corresponding encoding step may be further included. To better understand an entire encoding process of a stereo signal, the following describes a stereo signal encoding method that includes the method for reconstructing a signal during stereo signal encoding in the embodiments of this application in detail with reference to FIG. 9. The stereo signal encoding method in FIG. 9 includes the following steps.

901. Determine an inter-channel time difference in a current frame.

Specifically, the inter-channel time difference in the current frame is a time difference between a left sound channel signal and a right sound channel signal in the current frame.

It should be understood that a processed stereo signal herein may include a left sound channel signal and a right sound channel signal, and that the inter-channel time difference in the current frame may be obtained by estimating a delay between the left sound channel signal and the right sound channel signal. For example, a cross-correlation coefficient between a left sound channel and a right sound channel is calculated based on the left sound channel signal and the right sound channel signal in the current frame, and then an index value corresponding to a maximum value of the cross-correlation coefficient is used as the inter-channel time difference in the current frame.

Optionally, the inter-channel time difference may be estimated based on a preprocessed left-channel time-domain signal and a preprocessed right-channel time-domain signal in the current frame, to determine the inter-channel time difference in the current frame. When time-domain processing is performed on the stereo signal, high-pass filtering processing may be specifically performed on the left sound channel signal and the right sound channel signal in the current frame, to obtain a preprocessed left sound channel signal and a preprocessed left sound channel signal in the current frame. In addition, the time-domain preprocessing herein may be other processing such as pre-emphasis processing, in addition to high-pass filtering processing.

902. Perform delay alignment processing on the left sound channel signal and the right sound channel signal in the current frame based on the inter-channel time difference.

When delay alignment processing is performed on the left sound channel signal and the right sound channel signal in the current frame, compression or stretching processing may be performed on either or both of the left sound channel signal and the right sound channel signal based on the inter-channel time difference in the current frame, so that no inter-channel time difference exists between a left sound channel signal and a right sound channel signal obtained after delay alignment processing. Signals obtained after delay alignment processing is performed on the left sound channel signal and the right sound channel signal in the current frame are stereo signals obtained after delay alignment processing in the current frame.

When delay alignment processing is performed on the left sound channel signal and the right sound channel signal in the current frame based on the inter-channel time difference, a target sound channel and a reference sound channel in the current frame need to be first selected based on the inter-channel time difference in the current frame and an inter-channel time difference in a previous frame. Then, delay alignment processing may be performed in different manners depending on a result of comparison between an absolute value abs(cur_itd) of the inter-channel time difference in the current frame and an absolute value abs(prev_itd) of the inter-channel time difference in the previous frame of the current frame. Delay alignment processing may include stretching or compressing processing performed on the target sound channel signal and signal reconstruction processing.

Specifically, step 902 includes step 9021 to step 9027.

9021. Determine a reference sound channel and a target sound channel in a current frame.

An inter-channel time difference in the current frame is denoted as cur_itd, and an inter-channel time difference in a previous frame is denoted as prev_itd. Specifically, selecting the target sound channel and the reference sound channel in the current frame based on the inter-channel time difference in the current frame and the inter-channel time difference in the previous frame may be described in the following, if cur_itd=0, the target sound channel in the current frame remains consistent with a target sound channel in the previous frame; if cur_itd<0, the target sound channel in the current frame is a left sound channel; or if cur_itd>0, the target sound channel in the current frame is a right sound channel.

9022. Determine an adaptive length of a transition segment based on the inter-channel time difference in the current frame.

9023. Determine whether stretching or compression processing needs to be performed on a target sound channel signal, and if yes, perform stretching or compression processing on the target sound channel signal based on the inter-channel time difference in the current frame and the inter-channel time difference in the previous frame of the current frame.

Specifically, different manners may be used depending on a result of comparison between an absolute value abs(cur_itd) of the inter-channel time difference in the current frame and an absolute value abs(prev_itd) of the inter-channel time difference in the previous frame of the current frame. Specifically, the following three cases are included.

Case 1: abs(cur_itd) is equal to abs(prev_itd).

Figure 10:
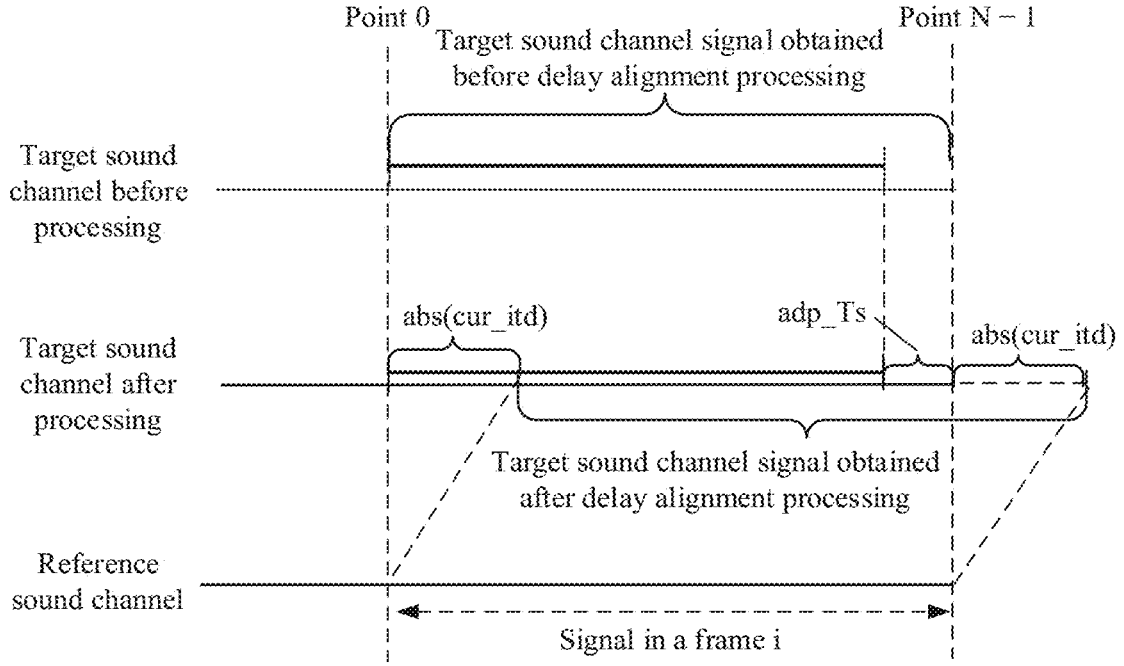
FIG. 10 is a schematic diagram of delay alignment processing according to an embodiment of this application.

When the absolute value of the inter-channel time difference in the current frame is equal to the absolute value of the inter-channel time difference in the previous frame of the current frame, no compression or stretching processing is performed on the target sound channel signal. As shown in FIG. 10, a signal from a point 0 to a point (N−adp_Ts−1) of the target sound channel signal in the current frame is directly used as a signal from the point 0 to the point (N−adp_Ts−1) on the target sound channel after delay alignment processing.

Case 2: abs(cur_itd) is less than abs(prev_itd).

Figure 11:
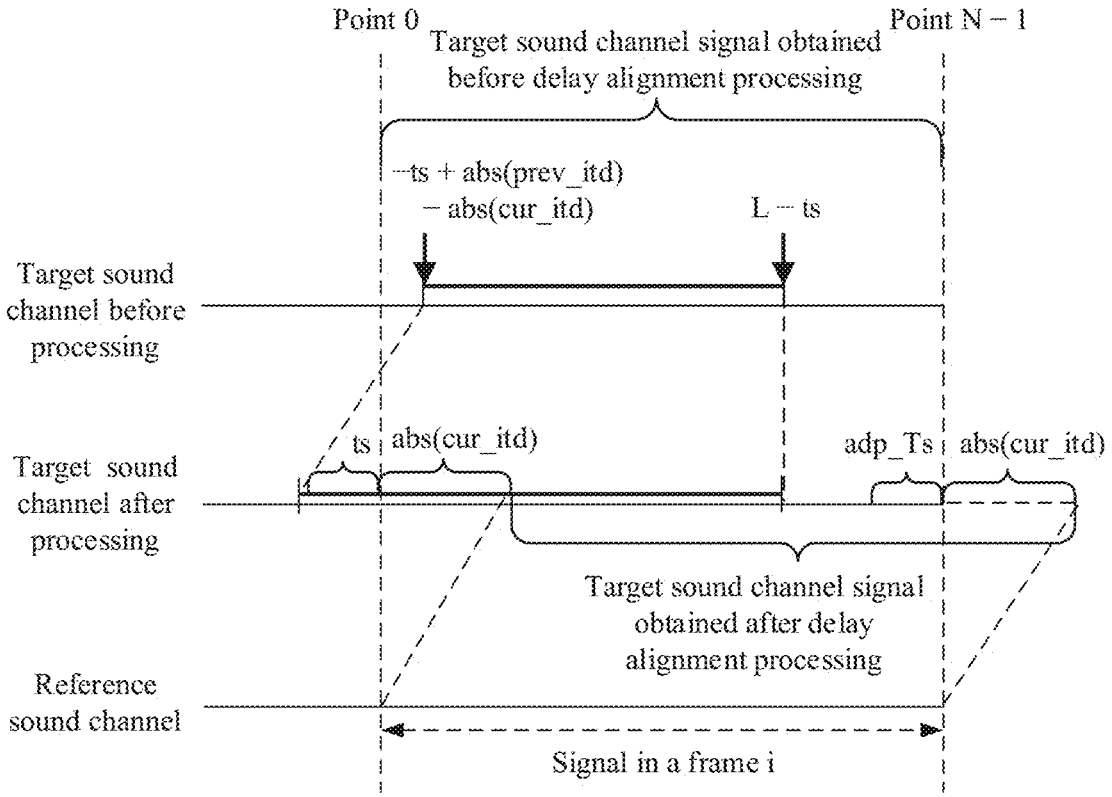
FIG. 11 is a schematic diagram of delay alignment processing according to an embodiment of this application.

As shown in FIG. 11, when the absolute value of the inter-channel time difference in the current frame is less than the absolute value of the inter-channel time difference in the previous frame of the current frame, a buffered target sound channel signal needs to be stretched. Specifically, a signal from a point (−ts+abs(prev_itd)−abs(cur_itd)) to a point (L−ts−1) of the target sound channel signal buffered in the current frame is stretched as a signal with a length of L points, and the signal obtained through stretching is used as a signal from a point −ts to the point (L−ts−1) on the target sound channel after delay alignment processing. Then, a signal from a point (L−ts) to a point (N−adp_Ts−1) of the target sound channel signal in the current frame is directly used as a signal from the point (L−ts) to the point (N−adp_Ts−1) on the target sound channel after delay alignment processing. adp_Ts represents the adaptive length of the transition segment, ts represents a length of an inter-frame smooth transition segment that is set to increase inter-frame smoothness, and L represents a processing length for delay alignment processing. L may be any positive integer less than or equal to the frame length N at a current rate. L is generally set to a positive integer greater than an allowable maximum inter-channel time difference. For example, L=290 or L=200. With regard to different sampling rates, the processing length L for delay alignment processing may be set to different values or a same value. Generally, a simplest method is to preset a value of L by a skilled person by experience, for example, the value is set to 290.

Case 3: abs(cur_itd) is greater than abs(prev_itd).

Figure 12:
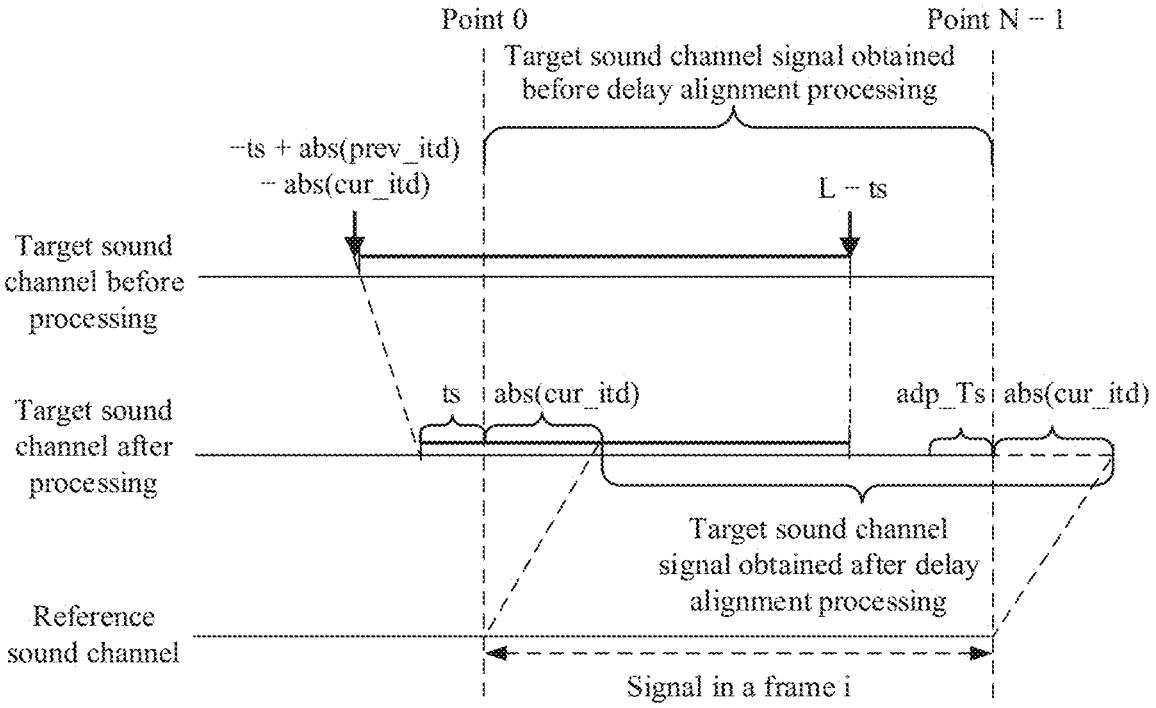
FIG. 12 is a schematic diagram of delay alignment processing according to an embodiment of this application.

As shown in FIG. 12, when the absolute value of the inter-channel time difference in the current frame is greater than the absolute value of the inter-channel time difference in the previous frame of the current frame, compression needs to be performed on a buffered target sound channel signal. Specifically, a signal from a point (−ts+abs(prev_itd)−abs(cur_itd)) to a point (L−ts−1) of the target sound channel signal buffered in the current frame is compressed as a signal with a length of L points, and the signal obtained through compression is used as a signal from a point −ts to the point (L−ts−1) on the target sound channel after delay alignment processing. Next, a signal from a point (L−ts) to a point (N−adp_Ts−1) of the target sound channel signal in the current frame is directly used as the signal from the point (L−ts) to the point (N−adp_Ts−1) on the target sound channel after delay alignment processing. adp_Ts represents the adaptive length of the transition segment, is represents a length of an inter-frame smooth transition segment that is set to increase inter-frame smoothness, and L still represents a processing length for delay alignment processing.

9024. Determine a transition window in the current frame based on the adaptive length of the transition segment.

9025. Determine a gain modification factor.

9026. Determine a transition segment signal on the target sound channel in the current frame based on the adaptive length of the transition segment, the transition window in the current frame, the gain modification factor in the current frame, a reference sound channel signal in the current frame, and a target sound channel signal in the current frame.

A signal with a length of adp_Ts points is generated based on the adaptive length of the transition segment, the transition window in the current frame, the gain modification factor, the reference sound channel signal in the current frame, and the target sound channel signal in the current frame. In other words, the transition segment signal on the target sound channel in the current frame is used as a signal from a point (N−adp_Ts) to a point (N−1) on the target sound channel after delay alignment processing.

9027. Determine a forward signal on the target sound channel in the current frame based on the gain modification factor and the reference sound channel signal in the current frame.

A signal with a length of abs(cur_itd) points is generated based on the gain modification factor and the reference sound channel signal in the current frame. In other words, the forward signal on the target sound channel in the current frame is used as a signal from a point N to a point (N−abs(cur_itd)−1) on the target sound channel after delay alignment processing.

It should be understood that, after delay alignment processing, a signal with a length of N points starting from a point abs(cur_itd) on the target sound channel after delay alignment processing is finally used as the target sound channel signal in the current frame after delay alignment processing. The reference sound channel signal in the current frame is directly used as the reference sound channel signal in the current frame after delay alignment.

903. Quantize the inter-channel time difference estimated in the current frame.

It should be understood that there are a plurality of methods for quantizing the inter-channel time difference. Specifically, quantization processing may be performed, by using any prior-art quantization algorithm, on the inter-channel time difference estimated in the current frame, to obtain a quantization index, and the quantization index is encoded and written into an encoded bitstream.

904. Based on the stereo signal on which delay alignment is performed in the current frame, calculate a sound channel combination ratio factor and perform quantization.

When time-domain downmixing processing is performed on a left sound channel signal and a right sound channel signal obtained after delay alignment processing, downmixing may be performed on the left sound channel signal and the right sound channel signal to obtain a mid channel (Mid channel) signal and a side channel (Side channel) signal. The mid channel signal can indicate related information between a left sound channel and a right sound channel, the side channel signal can indicate difference information between the left sound channel and the right sound channel.

Assuming that L indicates the left sound channel signal and R indicates the right sound channel signal, the mid channel signal is 0.5*(L+R) and the side channel signal is 0.5*(L−R).

In addition, when time-domain downmixing processing is performed on the left sound channel signal and the right sound channel signal obtained after delay alignment processing, to control a ratio of the left sound channel signal to the right sound channel signal in downmixing processing, the sound channel combination ratio factor may be further calculated. Then, time-domain downmixing processing is performed on the left sound channel signal and the right sound channel signal based on the sound channel combination ratio factor, to obtain a primary sound channel signal and a secondary sound channel signal.

There are a plurality of methods for calculating the sound channel combination ratio factor. For example, the sound channel combination ratio factor in the current frame may be calculated based on frame energy on the left sound channel and the right sound channel. A specific process is described as follows:

(1) Calculate frame energy of the left sound channel signal and the right sound channel signal in the current frame based on a left sound channel signal and a right sound channel signal obtained after delay alignment.

Frame energy rms_L on the left sound channel in the current frame satisfies:

$$\text{rms_L} = \frac{1}{N}\sum_{i=0}^{N-1} x'_L(i) * x'_L(i), \text{ where } i = 0, 1, \ldots, N-1 \tag{26}$$

Frame energy rms_R on the right sound channel in the current frame satisfies:

$$\text{rms_R} = \frac{1}{N}\sum_{i=0}^{N-1} x'_R(i) * x'_R(i), \text{ where } i = 0, 1, \ldots, N-1 \tag{27}$$

$x'_L(i)$ represents the left sound channel signal in the current frame obtained after delay alignment, and $x'_R(i)$ represents the right sound channel signal in the current frame obtained after delay alignment, where i represents a sampling point number.

(2) Calculate the sound channel combination ratio factor in the current frame based on the frame energy on the left sound channel and the right sound channel.

The sound channel combination ratio factor ratio in the current frame satisfies:

$$\text{ratio} = \frac{\text{rms_R}}{\text{rms_L} + \text{rms_R}} \tag{28}$$

Therefore, the sound channel combination ratio factor is calculated based on the frame energy of the left sound channel signal and the right sound channel signal.

(3) Quantize the sound channel combination ratio factor, and write the quantized sound channel combination ratio factor into a bitstream.

Specifically, the calculated sound channel combination ratio factor in the current frame is quantized to obtain a corresponding quantization index ratio_idx and a quantized sound channel combination ratio factor $\text{ratio}_{qua}$ in the current frame, where ratio_idx and $\text{ratio}_{qua}$ satisfy Formula (29):

$$\text{ratio}_{qua} = \text{ratio_tabl}[\text{ratio_idx}] \tag{29}$$

ratio_tabl represents a scalar quantized codebook. Quantization may be performed on the sound channel combination ratio factor by using any prior-art scalar quantization method, for example, uniform scalar quantization or non-uniform scalar quantization. A quantity of encoded bits may be 5 bits or the like.

905. Perform, based on the sound channel combination ratio factor, time-domain downmixing processing on the stereo signal obtained after delay alignment in the current frame, to obtain the primary sound channel signal and the secondary sound channel signal.

In step 905, downmixing processing may be performed by using any prior-art time-domain downmixing processing technology. However, it should be noted that, a corresponding time-domain downmixing processing manner needs to be selected based on a method for calculating the sound channel combination ratio factor, to perform time-domain downmixing processing on the stereo signal obtained after delay alignment, so as to obtain the primary sound channel signal and the secondary sound channel signal.

After the sound channel combination ratio factor ratio is obtained, time-domain downmixing processing may be performed based on the sound channel combination ratio factor ratio. For example, the primary sound channel signal and the secondary sound channel signal obtained after time-domain downmixing processing may be determined according to Formula (30):

$$\begin{bmatrix} Y(i) \\ X(i) \end{bmatrix} = \begin{bmatrix} \text{ratio} & 1-\text{ratio} \\ 1-\text{ratio} & -\text{ratio} \end{bmatrix} * \begin{bmatrix} x'_L(i) \\ x'_R(i) \end{bmatrix}, \quad (30)$$

where $i = 0, 1, \ldots, N-1$

Y(i) represents the primary sound channel signal in the current frame, X(i) represents the secondary sound channel signal in the current frame, $x'_L(i)$ represents a left sound channel signal in the current frame obtained after delay alignment, $x'_R(i)$ represents a right sound channel signal in the current frame obtained after delay alignment, i represents a sampling point number, N represents the frame length, and ratio represents the sound channel combination ratio factor.

906. Encode the primary sound channel signal and the secondary sound channel signal.

It should be understood that encoding processing may be performed, by using a mono signal encoding/decoding method, on the primary sound channel signal and the secondary sound channel signal obtained after downmixing processing. Specifically, bits to be encoded on a primary sound channel and a secondary sound channel may be allocated based on parameter information obtained in a process of encoding a primary sound channel signal and/or a secondary sound channel signal in a previous frame and a total quantity of bits to be used for encoding the primary sound channel signal and the secondary sound channel signal encoding. Then, the primary sound channel signal and the secondary sound channel signal are separately encoded based on a bit allocation result, to obtain encoding indexes obtained after the primary sound channel signal is encoded and encoding indexes obtained after the secondary sound channel signal is encoded. In addition, algebraic code excited linear prediction (ACELP) of an encoding scheme may be used to encode the primary sound channel signal and the secondary sound channel signal.

The foregoing describes the method for reconstructing a signal during stereo signal encoding in the embodiments of this application in detail with reference to FIG. 1 to FIG. 12. The following describes apparatuses for reconstructing a signal during stereo signal encoding in the embodiments of this application with reference to FIG. 13 to FIG. 16. It should be understood that the apparatuses in FIG. 13 to FIG. 16 are corresponding to the methods for reconstructing a signal during stereo signal encoding in the embodiments of this application. In addition, the apparatuses in FIG. 13 to FIG. 16 may perform the methods for reconstructing a signal during stereo signal encoding in the embodiments of this application. For brevity, repeated descriptions are appropriately omitted below.

Figure 13:
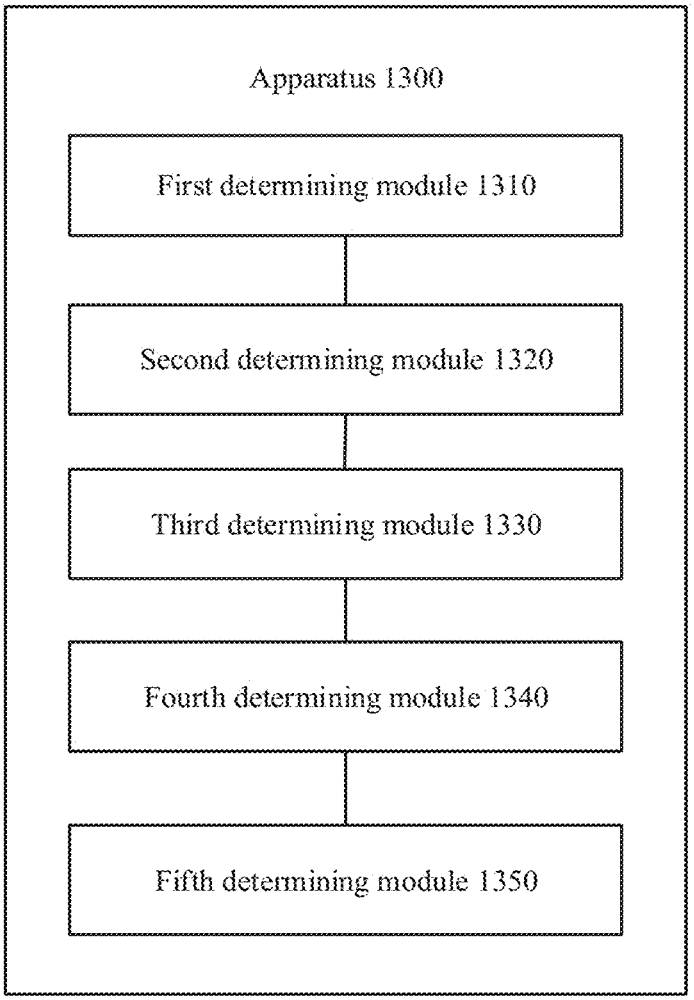
FIG. 13 is a schematic block diagram of an apparatus for reconstructing a signal during stereo signal encoding according to an embodiment of this application.

FIG. 13 is a schematic block diagram of an apparatus for reconstructing a signal during stereo signal encoding according to an embodiment of this application. The apparatus 1300 in FIG. 13 includes:

a first determining module 1310, configured to determine a reference sound channel and a target sound channel in a current frame;

a second determining module 1320, configured to determine an adaptive length of a transition segment in the current frame based on an inter-channel time difference in the current frame and an initial length of the transition segment in the current frame;

a third determining module 1330, configured to determine a transition window in the current frame based on the adaptive length of the transition segment in the current frame;

a fourth determining module 1340, configured to determine a gain modification factor of a reconstructed signal in the current frame; and a fifth determining module 1350, configured to determine a transition segment signal on the target sound channel in the current frame based on the inter-channel time difference in the current frame, the adaptive length of the transition segment in the current frame, the transition window in the current frame, the gain modification factor in the current frame, a reference sound channel signal in the current frame, and a target sound channel signal in the current frame.

In this application, the transition segment with the adaptive length is set, and the transition window is determined based on the adaptive length of the transition segment. Compared with a prior-art manner of determining the transition window by using a transition segment with a fixed length, a transition segment signal that can make smoother transition between a real signal on the target sound channel in the current frame and a manually reconstructed signal on the target sound channel in the current frame can be obtained.

Optionally, in an embodiment, the second determining module 1320 is specifically configured to: when an absolute value of the inter-channel time difference in the current frame is greater than or equal to the initial length of the transition segment in the current frame, determine the initial length of the transition segment in the current frame as the adaptive length of the transition segment in the current frame; or when an absolute value of the inter-channel time difference in the current frame is less than the initial length of the transition segment in the current frame, determine the absolute value of the inter-channel time difference in the current frame as the adaptive length of the transition segment.

Optionally, in an embodiment, the transition segment signal that is on the target sound channel in the current frame and that is determined by the fifth determining module 1350 satisfies the following formula:

$$\text{transition_seg}(i)=w(i)*g*\text{reference}(N-\text{adp_Ts}-\text{abs}(\text{cur_itd})+i)+(1-w(i))*\text{target}(N-\text{adp_Ts}+i),$$
$$\text{where } i=0,1,\ldots,\text{adp_Ts}-1,$$

transition_seg(.) represents the transition segment signal on the target sound channel in the current frame, adp_Ts represents the adaptive length of the transition segment in the current frame, w(.) represents the transition window in the current frame, g represents the gain modification factor in the current frame, target(.) represents the target sound channel signal in the current frame, reference(.) represents the reference sound channel signal in the current frame, cur_itd represents the inter-channel time difference in the current frame, abs(cur_itd) represents the absolute value of the inter-channel time difference in the current frame, and N represents a frame length of the current frame.

Optionally, in an embodiment, the fourth determining module 1340 is specifically configured to: determine an initial gain modification factor based on the transition window in the current frame, the adaptive length of the transition segment in the current frame, the target sound channel signal in the current frame, the reference sound channel signal in the current frame, and the inter-channel time difference in the current frame;

determine an initial gain modification factor based on the transition window in the current frame, the adaptive length of the transition segment in the current frame, the target sound channel signal in the current frame, the reference sound channel signal in the current frame, and the inter-channel time difference in the current frame; and modify the initial gain modification factor based on a first modification coefficient to obtain the gain modification factor in the current frame, where the first modification coefficient is a preset real number greater than 0 and less than 1; or determine an initial gain modification factor based on the inter-channel time difference in the current frame, the target sound channel signal in the current frame, and the reference sound channel signal in the current frame; and modify the initial gain modification factor based on a second modification coefficient to obtain the gain modification factor in the current frame, where the second modification coefficient is a preset real number greater than 0 and less than 1 or is determined according to a preset algorithm.

Optionally, in an embodiment, the initial gain modification factor determined by the fourth determining module 1340 satisfies the following formula:

$$g = \frac{-b + \sqrt{b^2 - 4ac}}{2a}, \text{ where}$$

$$a = \frac{1}{N - T_0}\sum_{i=T_d}^{N-1} y^2(i) + \left[\sum_{i=T_s}^{T_d-1} w(i - T_s)\cdot y(i)\right]^2,$$

$$b = \frac{2}{N - T_0}\sum_{i=T_s}^{T_d-1} [1 - w(i - T_s)]\cdot x(i + \text{abs(cur_itd)})\cdot w(i - T_s)\cdot y(i), \text{ and}$$

$$c = \frac{1}{N - T_0}\left[\sum_{i=T_0}^{T_s-1} x^2(i + \text{abs(cur_itd)}) + \sum_{i=T_s}^{T_d-1} [[1 - w(i - T_s)]x(i + \text{abs(cur_itd)})]^2\right] - \frac{K}{T_d - T_0}\sum_{i=T_0}^{T_d-1} x^2(i),$$

where

K represents an energy attenuation coefficient, K is a preset real number, and $0<K\leq 1$; g represents the gain modification factor in the current frame; w(.) represents the transition window in the current frame; x(.) represents the target sound channel signal in the current frame; y(.) represents the reference sound channel signal in the current frame; N represents the frame length of the current frame; $T_s$ represents a sampling point index that is of the target sound channel and that corresponds to a start sampling point index of the transition window $T_d$ represents a sampling point index that is of the target sound channel and that corresponds to an end sampling point index of the transition window, $T_s$=N−abs(cur_itd)−adp_Ts, $T_d$=N−abs(cur_itd), $T_0$ represents a preset start sampling point index that is of the target sound channel and that is used to calculate the gain modification factor, and $0\leq T_0<T_s$; cur_itd represents the inter-channel time difference in the current frame; abs(cur_itd) represents the absolute value of the inter-channel time difference in the current frame; and adp_Ts represents the adaptive length of the transition segment in the current frame.

Optionally, in an embodiment, the apparatus 1300 further includes: a sixth determining module 1360, configured to determine a forward signal on the target sound Channel in the current frame based on the inter-channel time difference in the current frame, the gain modification factor in the current frame, and the reference sound channel signal in the current frame.

Optionally, in an embodiment, the forward signal that is on the target sound channel in the current frame and that is determined by the sixth determining module 1360 satisfies the following formula:

$$\text{reconstruction_seg}(i)=g*\text{reference}(N-\text{abs(cur_itd)}+i),$$
$$\text{where } i=0,1,\ldots,\text{abs(cur_itd)}-1,$$

reconstruction_seg(.) represents the forward signal on the target sound channel in the current frame, g represents the gain modification factor in the current frame, reference(.) represents the reference sound channel signal in the current frame, cur_itd represents the inter-channel time difference in the current frame, abs(cur_itd) represents the absolute value of the inter-channel time difference in the current frame, and N represents the frame length of the current frame.

Optionally, in an embodiment, when the second modification coefficient is determined according to the preset algorithm, the second modification coefficient is determined based on the reference sound channel signal and the target sound channel signal in the current frame, the inter-channel time difference in the current frame, the adaptive length of the transition segment in the current frame, the transition window in the current frame, and the gain modification factor in the current frame.

Optionally, in an embodiment, the second modification coefficient satisfies the following formula:

$$\text{adj_fac} = \frac{\frac{K}{T_d - T_0}\sum_{i=T_0}^{T_d-1} x^2(i)}{\frac{1}{N - T_s}\left[\sum_{i=T_s}^{T_d-1}\left[\begin{array}{c}[1 - w(i - T_s)]\cdot x(i + \text{abs(cur_itd)}) + \\ w(i - T_s)\cdot g\cdot y(i)\end{array}\right]^2 + \sum_{i=T_d}^{N-1} g^2\cdot y^2(i)\right]},$$

where adj_fac represents the second modification coefficient; K represents the energy attenuation coefficient, K is the preset real number, $0<K\leq 1$, and a value of K may be set by a skilled person by experience; g represents the gain modification factor in the current frame; w(.) represents the transition window in the current frame; x(.) represents the target sound channel signal in the current frame; y(.) represents the reference sound channel signal in the current frame; N represents the frame length of the current frame; $T_s$ represents the sampling point index of the target sound channel corresponding to the stark sampling point index of the transition window; $T_d$ represents the sampling point index of the target sound channel corresponding to the end sampling point index of the transition window, $T_s$=N−abs(cur_itd)−adp_Ts, and $T_d$=N−abs(cur_itd); $T_0$ represents the preset start sampling point index that is of the target sound channel and that is used to calculate the gain modification factor, and $0 \le T_0 < T_s$; cur_itd represents the inter-channel time difference in the current frame; abs(cur_itd) represents the absolute value of the inter-channel time difference in the current frame; and adp_Ts represents the adaptive length of the transition segment in the current frame.

Optionally, in an embodiment, the second modification coefficient satisfies the following formula:

$$\text{adj_fac} = \frac{\dfrac{K}{T_d - T_0}\sum_{i=T_0}^{T_d-1} x^2(i)}{\dfrac{1}{N - T_0}\left[\begin{array}{c}\sum_{i=T_0}^{T_s-1} x^2(i + \text{abs(cur_itd)}) + \sum_{i=T_s}^{T_d-1} \\ \left[\begin{array}{c}[1 - w(i - T_s)]\cdot x(i + \text{abs(cur_itd)}) + \\ w(i - T_s)\cdot g\cdot y(i)\end{array}\right]^2 + \\ \sum_{i=T_d}^{N-1} g^2\cdot y^2(i)\end{array}\right]},$$

where adj_fac represents the second modification coefficient; K represents the energy attenuation coefficient, K is the preset real number, $0<K\le 1$, and a value of K may be set by a skilled person by experience; g represents the gain modification factor in the current frame; w(.) represents the transition window in the current frame; x(.) represents the target sound channel signal in the current frame; y(.) represents the reference sound channel signal in the current frame; N represents the frame length of the current frame; $T_s$ represents the sampling point index of the target sound channel corresponding to the start sampling point index of the transition window; $T_d$ represents the sampling point index of the target sound channel corresponding to the end sampling point index of the transition window, $T_s$=N−abs(cur_itd)−adp_Ts, and $T_d$=N−abs(cur_itd); $T_0$ represents the preset start sampling point index of the target sound Channel used to calculate the gain modification factor, and $0 \le T_0 < T_s$; cur_itd represents the inter-channel time difference in the current frame; abs(cur_itd) represents the absolute value of the inter-channel time difference in the current frame; and adp_Ts represents the adaptive length of the transition segment in the current frame.

Figure 14:
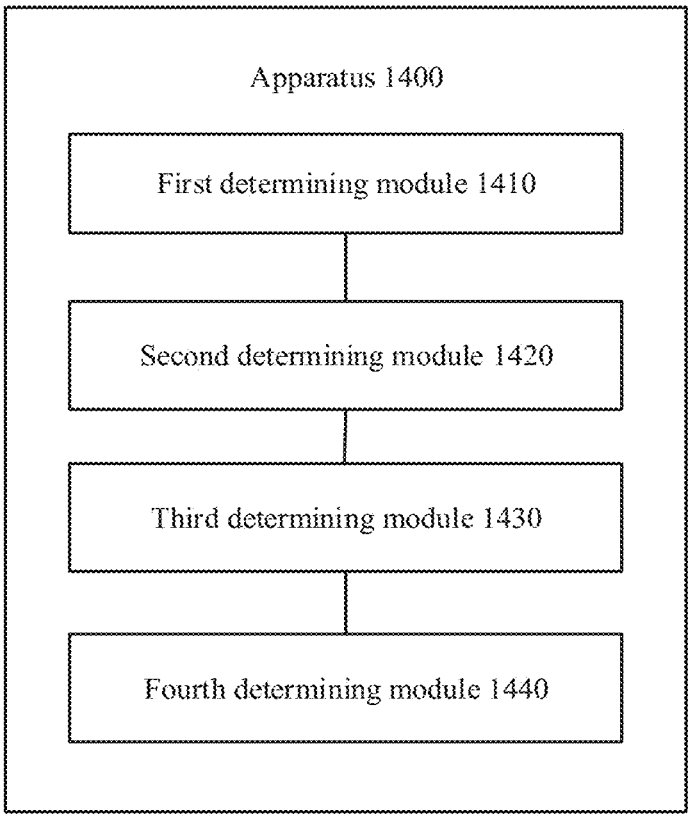
FIG. 14 is a schematic block diagram of an apparatus for reconstructing a signal during stereo signal encoding according to an embodiment of this application.

FIG. 14 is a schematic block diagram of an apparatus for reconstructing a signal during stereo signal encoding according to an embodiment of this application. The apparatus 1400 in FIG. 14 includes:

a first determining module 1410, configured to determine a reference sound channel and a target sound channel in a current frame;

a second determining module 1420, configured to determine an adaptive length of a transition segment in the current frame based on an inter-channel time difference in the current frame and an initial length of the transition segment in the current frame;

a third determining module 1430, configured to determine a transition window in the current frame based on the adaptive length of the transition segment in the current frame; and a fourth determining module 1440, configured to determine a transition segment signal on the target sound channel in the current frame based on the adaptive length of the transition segment in the current frame, the transition window in the current frame, and a target sound channel signal in the current frame.

In this application, the transition segment with the adaptive length is set, and the transition window is determined based on the adaptive length of the transition segment. Compared with a prior-art manner of determining the transition window by using a transition segment with a fixed length, a transition segment signal that can make smoother transition between a real signal on the target sound channel in the current frame and a manually reconstructed signal on the target sound channel in the current frame can be obtained.

Optionally, in an embodiment, the apparatus 1400 further includes:

a processing module 1450, configured to set a forward signal on the target sound channel in the current frame to zero.

Optionally, in an embodiment, the second determining module 1420 is specifically configured to: when an absolute value of the inter-channel time difference in the current frame is greater than or equal to the initial length of the transition segment in the current frame, determine the initial length of the transition segment in the current frame as the adaptive length of the transition segment in the current frame; or when an absolute value of the inter-channel time difference in the current frame is less than the initial length of the transition segment in the current frame, determine the absolute value of the inter-channel time difference in the current frame as the adaptive length of the transition segment.

Optionally, in an embodiment, the transition segment signal that is on the target sound channel in the current frame and that is determined by the fourth determining module 1440 satisfies the following formula:

$$\text{transition_seg}(i)=(1-w(i))*\text{target}(N-\text{adp_Ts}+i),\ \text{where}\ i=0,1,\ldots,\text{adp_Ts}-1,$$

transition_seg(.) represents the transition segment signal on the target sound channel in the current frame, adp_Ts represents the adaptive length of the transition segment in the current frame, w(.) represents the transition window in the current frame, target(.) represents the target sound channel signal in the current frame, cur_itd represents the inter-channel time difference in the current frame, abs(cur_itd) represents the absolute value of the inter-channel time difference in the current frame, and N represents a frame length of the current frame.

Figure 15:
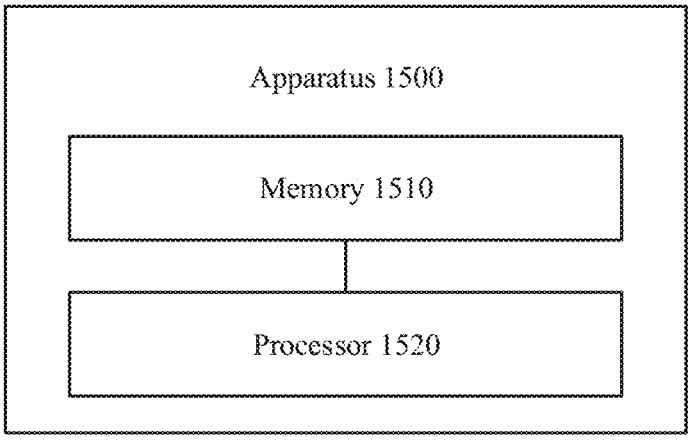
FIG. 15 is a schematic block diagram of an apparatus for reconstructing a signal during stereo signal encoding according to an embodiment of this application.

FIG. 15 is a schematic block diagram of an apparatus for reconstructing a signal during stereo signal encoding according to an embodiment of this application. The apparatus 1500 in FIG. 15 includes:

a memory 1510, configured to store a program; and a processor 1520, configured to execute the program stored in the memory 1510, and when the program in the memory 1510 is executed, the processor 1520 is specifically configured to: determine a reference sound channel and a target sound channel in a current frame; determine an adaptive length of a transition segment in the current frame based on an inter-channel time difference in the current frame and an initial length of the transition segment in the current frame; determine a transition window in the current frame based on the adaptive length of the transition segment in the current frame; determine a gain modification factor of a reconstructed signal in the current frame; and determine a transition segment signal on the target sound channel in the current frame based on the inter-channel time difference in the current frame, the adaptive length of the transition segment in the current frame, the transition window in the current frame, the gain modification factor in the current frame, a reference sound channel signal in the current frame, and a target sound channel signal in the current frame.

Optionally, in an embodiment, the processor 1520 is specifically configured to: when an absolute value of the inter-channel time difference in the current frame is greater than or equal to the initial length of the transition segment in the current frame, determine the initial length of the transition segment in the current frame as the adaptive length of the transition segment in the current frame; or when an absolute value of the inter-channel time difference in the current frame is less than the initial length of the transition segment in the current frame, determine the absolute value of the inter-channel time difference in the current frame as the adaptive length of the transition segment.

Optionally, in an embodiment, the transition segment signal on the target sound channel in the current frame and that is determined by the processor 1520 satisfies the following formula:

$$\text{transition_seg}(i)=w(i)*\text{reference}(N-\text{adp_Ts}-\text{abs}(\text{cur_itd})+i)+(1-w(i))*\text{target}(N-\text{adp_Ts}+i),\ \text{where}\ i=0,1,\ldots,\text{adp_Ts}-1,$$

transition_seg(.) represents the transition segment signal on the target sound channel in the current frame, adp_Ts represents the adaptive length of the transition segment in the current frame, w(.) represents the transition window in the current frame, g represents the gain modification factor in the current frame, target(.) represents the target sound channel signal in the current frame, reference(.) represents the reference sound channel signal in the current frame, cur_itd represents the inter-channel time difference in the current frame, abs(cur_itd) represents the absolute value of the inter-channel time difference in the current frame, and N represents a frame length of the current frame.

Optionally, in an embodiment, the processor 1520 is specifically configured to:

determine an initial gain modification factor based on the transition window in the current frame, the adaptive length of the transition segment in the current frame, the target sound channel signal in the current frame, the reference sound channel signal in the current frame, and the inter-channel time difference in the current frame;

determine an initial gain modification factor based on the transition window in the current frame, the adaptive length of the transition segment in the current frame, the target sound channel signal in the current frame, the reference sound channel signal in the current frame, and the inter-channel time difference in the current frame; and modify the initial gain modification factor based on a first modification coefficient to obtain the gain modification factor in the current frame, where the first modification coefficient is a preset real number greater than 0 and less than 1; or determine an initial gain modification factor based on the inter-channel time difference in the current frame, the target sound channel signal in the current frame, and the reference sound channel signal in the current frame; and modify the initial gain modification factor based on a second modification coefficient to obtain the gain modification factor in the current frame, where the second modification coefficient is a preset real number greater than 0 and less than 1 or is determined according to a preset algorithm.

Optionally, in an embodiment, the initial gain modification factor determined by the processor 1520 satisfies the following formula:

$$g=\frac{-b+\sqrt{b^2-4ac}}{2a},\ \text{where}$$

$$a=\frac{1}{N-T_0}\sum_{i=T_d}^{N-1}y^2(i)+\left[\sum_{i=T_s}^{T_d-1}w(i-T_s)\cdot y(i)\right]^2,$$

$$b=\frac{2}{N-T_0}\sum_{i=T_s}^{T_d-1}[1-w(i-T_s)]\cdot x(i+\text{abs}(\text{cur_itd}))\cdot w(i-T_s)\cdot y(i),\ \text{and}$$

$$c=\frac{1}{N-T_0}\left[\sum_{i=T_0}^{T_s-1}x^2(i+\text{abs}(\text{cur_itd}))+\sum_{i=T_s}^{T_d-1}[[1-w(i-T_s)]x(i+\text{abs}(\text{cur_itd}))]^2\right]-\frac{K}{T_d-T_0}\sum_{i=T_0}^{T_d-1}x^2(i),$$

where

K represents an energy attenuation coefficient, K is a preset real number, and $0<K\leq 1$; g represents the gain modification factor in the current frame; w(.) represents the transition window in the current frame; x(.) represents the target sound channel signal in the current frame; y(.) represents the reference sound channel signal in the current frame; N represents the frame length of the current frame; $T_s$ represents a sampling point index that is of the target sound channel and that corresponds to a start sampling point index of the transition window, $T_d$ represents a sampling point index that is of the target sound channel and that corresponds to an end sampling point index of the transition window, $T_s$=N−abs(cur_itd)−adp_Ts, $T_d$=N−abs(cur_itd), $T_0$ represents a preset start sampling point index that is of the target sound channel and that is used to calculate the gain modification factor, and $0\leq T_0<T_s$; cur_itd represents the inter-channel time difference in the current frame; abs(cur_itd) represents the absolute value of the inter-channel time difference in the current frame; and adp_Ts represents the adaptive length of the transition segment in the current frame.

Optionally, in an embodiment, the processor 1520 is further configured to determine a forward signal on the target sound channel in the current frame based on the inter-channel time difference in the current frame, the gain modification factor in the current frame, and the reference sound channel signal in the current frame.

Optionally, in an embodiment, the forward signal that is on the target sound channel in the current frame and that is determined by the processor 1520 satisfies the following formula:

$$\text{reconstruction_seg}(i)=g*\text{reference}(N-\text{abs}(\text{cur_itd})+i),\ \text{where}\ i=0,1,\ldots,\text{abs}(\text{cur_itd})-1,$$

reconstruction_seg(.) represents the forward signal on the target sound channel in the current frame, g represents the gain modification factor in the current frame, reference(.) represents the reference sound channel signal in the current frame, cur_itd represents the inter-channel time difference in the current frame, abs(cur_itd) represents the absolute value of the inter-channel time difference in the current frame, and N represents the frame length of the current frame.

Optionally, in an embodiment, when the second modification coefficient is determined according to the preset algorithm, the second modification coefficient is determined based on the reference sound channel signal and the target sound channel signal in the current frame, the inter-channel time difference in the current frame, the adaptive length of the transition segment in the current frame, the transition window in the current frame, and the gain modification factor in the current frame.

Optionally, in an embodiment, the second modification coefficient satisfies the following formula:

$$\text{adj_fac} = \frac{\frac{K}{T_d - T_0}\sum_{i=T_0}^{T_d-1} x^2(i)}{\frac{1}{N-T_s}\left[\sum_{i=T_s}^{T_d-1}\left[\begin{array}{c}[1-w(i-T_s)]\cdot x(i+\text{abs(cur_itd)})+\\ w(i-T_s)\cdot g\cdot y(i)\end{array}\right]^2+\sum_{i=T_d}^{N-1} g^2\cdot y^2(i)\right]},$$

where adj_fac represents the second modification coefficient, K represents the energy attenuation coefficient, K is the preset real number, $0<K\leq 1$, and a value of K may be set by a skilled person by experience; g represents the gain modification factor in the current frame; w(.) represents the transition window in the current frame; x(.) represents the target sound channel signal in the current frame; y(.) represents the reference sound channel signal in the current frame; N represents the frame length of the current frame; $T_s$ represents the sampling point index of the target sound channel corresponding to the start sampling point index of the transition window, $T_d$ represents the sampling point index of the target sound channel corresponding to the end sampling point index of the transition window, $T_s$=N−abs(cur_itd)−adp_Ts, $T_d$=N−abs(cur_itd), $T_0$ represents the preset start sampling point index of the target sound channel used to calculate the gain modification factor, and $0\leq T_0<T_s$; cur_itd represents the inter-channel time difference in the current frame; abs(cur_itd) represents the absolute value of the inter-channel time difference in the current frame; and adp_Ts represents the adaptive length of the transition segment in the current frame.

Optionally, in an embodiment, the second modification coefficient satisfies the following formula:

$$\text{adj_fac} = \frac{\frac{K}{T_d - T_0}\sum_{i=T_0}^{T_d-1} x^2(i)}{\frac{1}{N-T_0}\left[\begin{array}{c}\sum_{i=T_0}^{T_s-1} x^2(i+\text{abs(cur_itd)})+\sum_{i=T_s}^{T_d-1}\\ \left[\begin{array}{c}[1-w(i-T_s)]\cdot x(i+\text{abs(cur_itd)})+\\ w(i-T_s)\cdot g\cdot y(i)\end{array}\right]^2+\\ \sum_{i=T_d}^{N-1} g^2\cdot y^2(i)\end{array}\right]},$$

where adj_fac represents the second modification coefficient; K represents the energy attenuation coefficient, K is the preset real number, $0<K\leq 1$, and a value of K may be set by a skilled person by experience; g represents the gain modification factor in the current frame; w(.) represents the transition window in the current frame; x(.) represents the target sound channel signal in the current frame; y(.) represents the reference sound channel signal in the current frame; N represents the frame length of the current frame; $T_s$ represents the sampling point index that is of the target sound channel and that corresponds to the start sampling point index of the transition window $T_d$ represents the sampling point index that is of the target sound channel and that corresponds to the end sampling point index of the transition window, $T_s$=N−abs(cur_itd)−adp_Ts, and $T_d$=N−abs(cur_itd); $T_0$ represents the preset start sampling point index that is of the target sound channel and that is used to calculate the gain modification factor, and $0\leq T_0<T_s$; cur_itd represents the inter-channel time difference in the current frame; abs(cur_itd) represents the absolute value of the inter-channel time difference in the current frame; and adp_Ts represents the adaptive length of the transition segment in the current frame.

Figure 16:
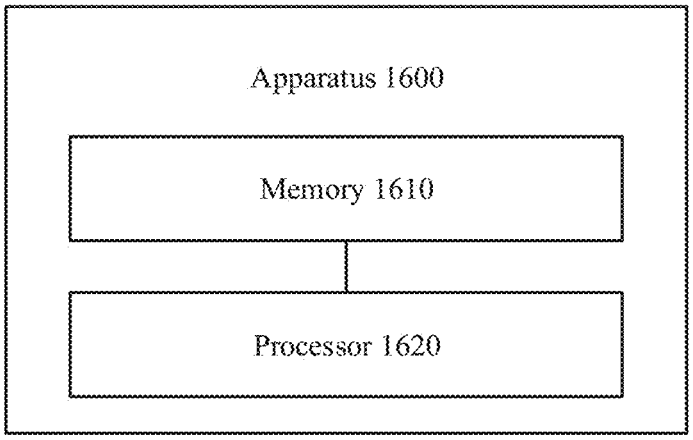
FIG. 16 is a schematic block diagram of an apparatus for reconstructing a signal during stereo signal encoding according to an embodiment of this application.

FIG. 16 is a schematic block diagram of an apparatus for reconstructing a signal during stereo signal encoding according to an embodiment of this application. The apparatus 1600 in FIG. 16 includes:

a memory 1610, configured to store a program; and a processor 1620, configured to execute the program stored in the memory 1610, and when the program in the memory 1610 is executed, the processor 1620 is specifically configured to: determine a reference sound channel and a target sound channel in a current frame; determine an adaptive length of a transition segment in the current frame based on an inter-channel time difference in the current frame and an initial length of the transition segment in the current frame; determine a transition window in the current frame based on the adaptive length of the transition segment in the current frame; and determine a transition segment signal on the target sound channel in the current frame based on the adaptive length of the transition segment in the current frame, the transition window in the current frame, and a target sound channel signal in the current frame.

Optionally, in an embodiment, the processor 1620 is further configured to set a forward signal on the target sound channel in the current frame to zero.

Optionally, in an embodiment, the processor 1620 is specifically configured to: when an absolute value of the inter-channel time difference in the current frame is greater than or equal to the initial length of the transition segment in the current frame, determine the initial length of the transition segment in the current frame as the adaptive length of the transition segment in the current frame; or when an absolute value of the inter-channel time difference in the current frame is less than the initial length of the transition segment in the current frame, determine the absolute value of the inter-channel time difference in the current frame as the adaptive length of the transition segment.

Optionally, in an embodiment, the transition segment signal that is on the target sound channel in the current frame and that is determined by the processor 1620 satisfies the following formula:

$$\text{transition_seg}(i)=(1-w(i))*\text{target}(N-\text{adp_Ts}+1),\quad \text{where } i=0,1,\ldots,\text{adp_Ts}-1,$$

transition_seg(.) represents the transition segment signal on the target sound channel in the current frame, adp_Ts represents the adaptive length of the transition segment in the current frame, w(.) represents the transition window in the current frame, target(.) represents the target sound channel signal in the current frame, cur_itd represents the inter-channel time difference in the current frame, abs(cur_itd)

represents the absolute value of the inter-channel time difference in the current frame, and N represents a frame length of the current frame.

Figure 17:
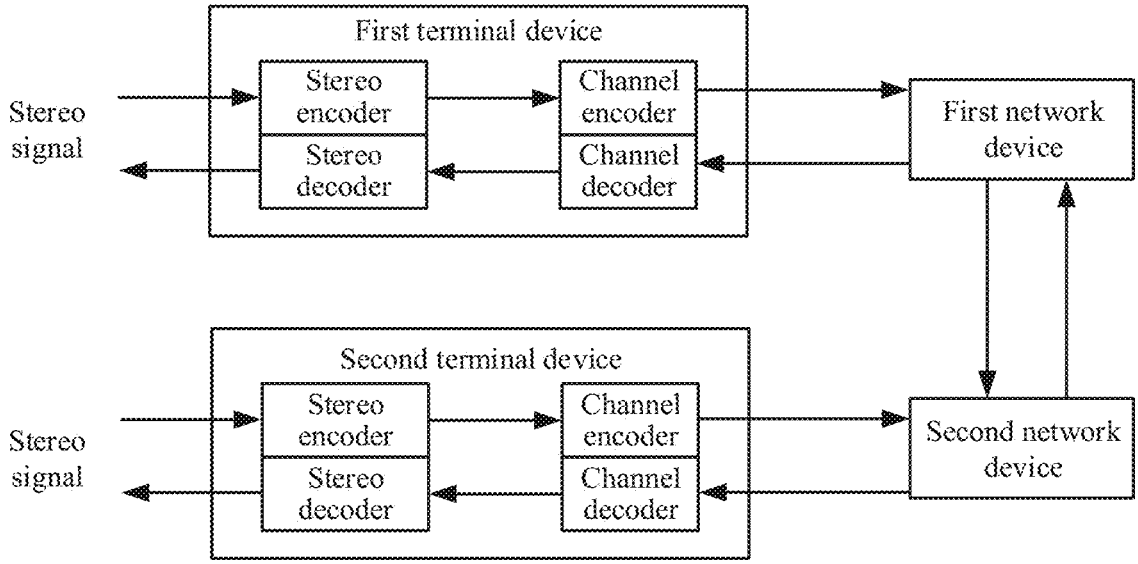
FIG. 17 is a schematic diagram of a terminal device according to an embodiment of this application.
Figure 18:
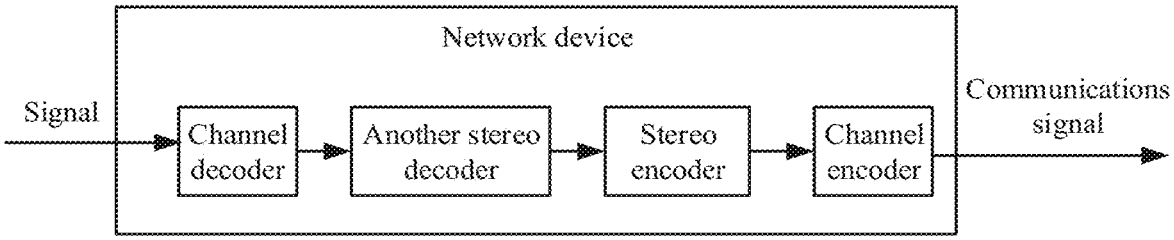
FIG. 18 is a schematic diagram of a network device according to an embodiment of this application.
Figure 19:
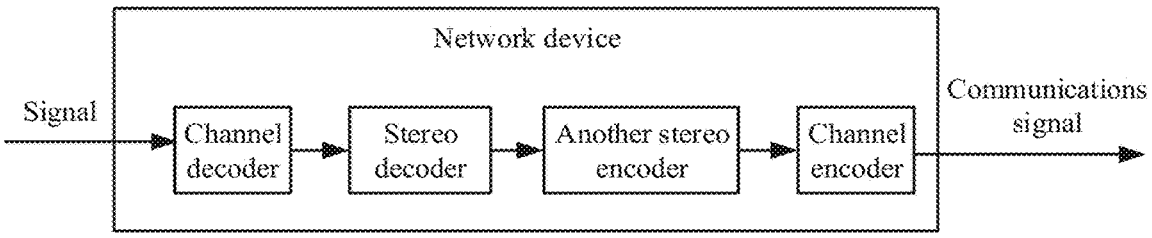
FIG. 19 is a schematic diagram of a network device according to an embodiment of this application.

It should be understood that a stereo signal encoding method and a stereo signal decoding method in the embodiments of this application may be performed by a terminal device or a network device in FIG. 17 to FIG. 19. In addition, an encoding apparatus and a decoding apparatus in the embodiments of this application may be further disposed in the terminal device or the network device in FIG. 17 to FIG. 19. Specifically, the encoding apparatus in the embodiments of this application may be a stereo encoder in the terminal device or the network device in FIG. 17 to FIG. 19, and the decoding apparatus in the embodiments of this application may be a stereo decoder in the terminal device or the network device in FIG. 17 to FIG. 19.

As shown in FIG. 17, in audio communication, a stereo encoder in a first terminal device performs stereo encoding on a collected stereo signal, and a channel encoder in the first terminal device may perform channel encoding on a bitstream obtained by the stereo encoder. Next, the first terminal device transmits, by using a first network device and a second network device, data obtained after channel encoding to the second terminal device. After the second terminal device receives the data from the second network device, a channel decoder of the second terminal device performs channel decoding to obtain an encoded bitstream of the stereo signal. A stereo decoder of the second terminal device restores the stereo signal through decoding, and the second terminal device plays back the stereo signal. In this way, audio communication is completed between different terminal devices.

It should be understood that, in FIG. 17, the second terminal device may also encode the collected stereo signal, and finally transmit, by using the second network device and the first network device, data obtained after encoding to the first terminal device. The first terminal device performs channel decoding and stereo decoding on the data to obtain the stereo signal.

In FIG. 17, the first network device and the second network device may be wireless network communications devices or wired network communications devices. The first network device and the second network device may communicate with each other on a digital channel.

The first terminal device or the second terminal device in FIG. 17 may perform the stereo signal encoding/decoding method in the embodiments of this application. The encoding apparatus and the decoding apparatus in the embodiments of this application may be respectively a stereo encoder and a stereo decoder in the first terminal device, or may be respectively a stereo encoder and a stereo decoder in the second terminal device.

In audio communication, a network device can implement transcoding of a codec format of an audio signal. As shown in FIG. 18, if a codec format of a signal received by a network device is a codec format corresponding to another stereo decoder, a channel decoder in the network device performs channel decoding on the received signal to obtain an encoded bitstream corresponding to the another stereo decoder. The another stereo decoder decodes the encoded bitstream to obtain a stereo signal. A stereo encoder encodes the stereo signal to obtain an encoded bitstream of the stereo signal. Finally, a channel encoder performs channel encoding on the encoded bitstream of the stereo signal to obtain a final signal (where the signal may be transmitted to a terminal device or another network device). It should be understood that a codec format corresponding to the stereo encoder in FIG. 18 is different from the codec format corresponding to the another stereo decoder. Assuming that the codec format corresponding to the another stereo decoder is a first codec format, and that the codec format corresponding to the stereo encoder is a second codec format, in FIG. 18, converting an audio signal from the first codec format to the second codec format is implemented by the network device.

Similarly, as shown in FIG. 19, if a codec format of a signal received by a network device is the same as a codec format corresponding to a stereo decoder, after a channel decoder of the network device performs channel decoding to obtain an encoded bitstream of a stereo signal, the stereo decoder may decode the encoded bitstream of the stereo signal to obtain the stereo signal. Next, another stereo encoder encodes the stereo signal based on another codec format, to obtain an encoded bitstream corresponding to the another stereo encoder. Finally, a channel encoder performs channel encoding on the encoded bitstream corresponding to the another stereo encoder to obtain a final signal (where the signal may be transmitted to a terminal device or another network device). Similar to the case in FIG. 18, the codec format corresponding to the stereo decoder in FIG. 19 is also different from a codec format corresponding to the another stereo encoder. If the codec format corresponding to the another stereo encoder is a first codec format, and the codec format corresponding to the stereo decoder is a second codec format, in FIG. 19, converting an audio signal from the second codec format to the first codec format is implemented by the network device.

The another stereo decoder and the stereo encoder in FIG. 18 are corresponding to different codec formats, and the stereo decoder and the another stereo encoder in FIG. 19 are corresponding to different codec formats. Therefore, transcoding of a codec format of a stereo signal is implemented through processing performed by the another stereo decoder and the stereo encoder or performed by the stereo decoder and the another stereo encoder.

It should be further understood that the stereo encoder in FIG. 18 can implement the stereo signal encoding method in the embodiments of this application, and the stereo decoder in FIG. 19 can implement the stereo signal decoding method in the embodiments of this application. The encoding apparatus in the embodiments of this application may be the stereo encoder in the network device in FIG. 18. The decoding apparatus in the embodiments of this application may be the stereo decoder in the network device in FIG. 19. In addition, the network devices in FIG. 18 and FIG. 19 may be specifically wireless network communications devices or wired network communications devices.

Figure 20:
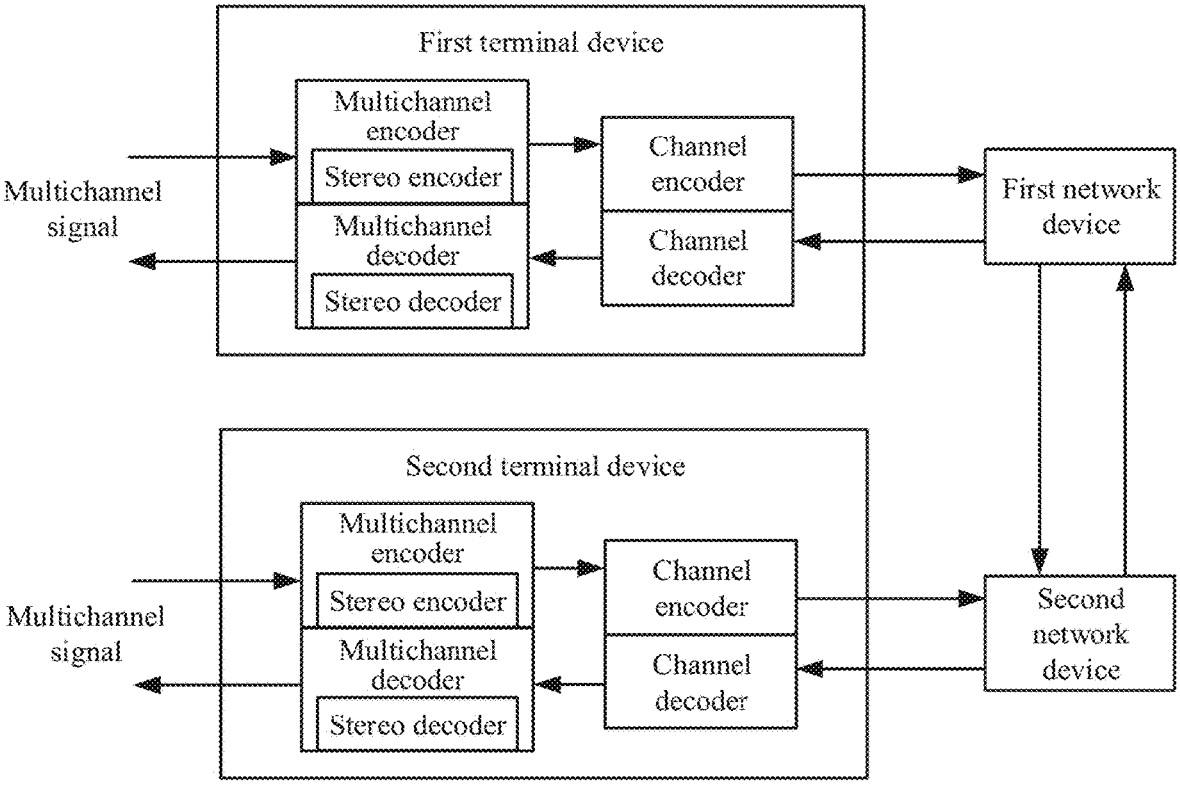
FIG. 20 is a schematic diagram of a terminal device according to an embodiment of this application.
Figure 21:
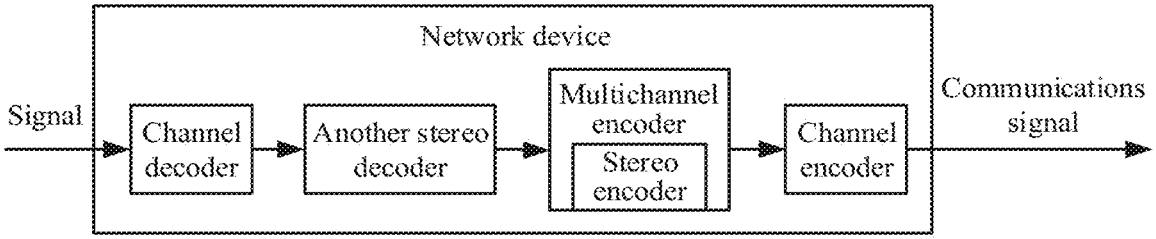
FIG. 21 is a schematic diagram of a network device according to an embodiment of this application.
Figure 22:
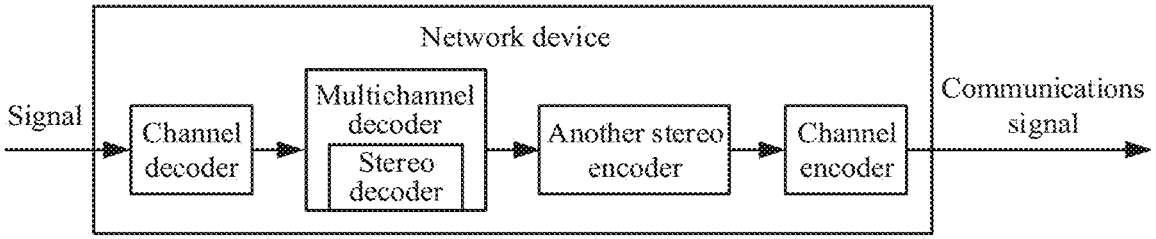
FIG. 22 is a schematic diagram of a network device according to an embodiment of this application.

It should be understood that the stereo signal encoding method and the stereo signal decoding method in the embodiments of this application may be alternatively performed by a terminal device or a network device in FIG. 20 to FIG. 22. In addition, the encoding apparatus and the decoding apparatus in the embodiments of this application may be alternatively disposed in the terminal device or the network device in FIG. 20 to FIG. 22. Specifically, the encoding apparatus in the embodiments of this application may be a stereo encoder in a multichannel encoder in the terminal device or the network device in FIG. 20 to FIG. 22. The decoding apparatus in the embodiments of this application may be a stereo decoder in a multichannel decoder in the terminal device or the network device in FIG. 20 to FIG. 22.

As shown in FIG. 20, in audio communication, a stereo encoder in a multichannel encoder in a first terminal device performs stereo encoding on a stereo signal generated from a collected multichannel signal, where a bitstream obtained by the multichannel encoder includes a bitstream obtained by the stereo encoder. A channel encoder in the first terminal device may perform channel encoding on the bitstream obtained by the multichannel encoder. Next, the first terminal device transmits, by using a first network device and a second network device, data obtained after channel encoding to a second terminal device. After the second terminal device receives the data from the second network device, a channel decoder of the second terminal device performs channel decoding to obtain an encoded bitstream of the multichannel signal, where the encoded bitstream of the multichannel signal includes an encoded bitstream of a stereo signal. A stereo decoder in a multichannel decoder of the second terminal device restores the stereo signal through decoding. The multichannel decoder obtains the multichannel signal through decoding based on the restored stereo signal, and the second terminal device plays back the multichannel signal. In this way, audio communication is completed between different terminal devices.

It should be understood that, in FIG. 20, the second terminal device may also encode the collected multichannel signal (specifically, a stereo encoder in a multichannel encoder in the second terminal device performs stereo encoding on a stereo signal generated from the collected multichannel signal. Then, a channel encoder in the second terminal device performs channel encoding on a bitstream obtained by the multichannel encoder), and finally transmits the encoded bitstream to the first terminal device by using the second network device and the first network device. The first terminal device obtains the multichannel signal through channel decoding and multichannel decoding.

In FIG. 20, the first network device and the second network device may be wireless network communications devices or wired network communications devices. The first network device and the second network device may communicate with each other on a digital channel.

The first terminal device or the second terminal device in FIG. 20 may perform the stereo signal encoding/decoding method in the embodiments of this application. In addition, the encoding apparatus in the embodiments of this application may be the stereo encoder in the first terminal device or the second terminal device, and the decoding apparatus in the embodiments of this application may be the stereo decoder in the first terminal device or the second terminal device.

In audio communication, a network device can implement transcoding of a codec format of an audio signal. As shown in FIG. 21, if a codec format of a signal received by a network device is a codec format corresponding to another multichannel decoder, a channel decoder in the network device performs channel decoding on the received signal to obtain an encoded bitstream corresponding to the another multichannel decoder. The another multichannel decoder decodes the encoded bitstream to obtain a multichannel signal. A multichannel encoder encodes the multichannel signal to obtain an encoded bitstream of the multichannel signal. A stereo encoder in the multichannel encoder performs stereo encoding on a stereo signal generated from the multichannel signal, to obtain an encoded bitstream of the stereo signal, where the encoded bitstream of the multichannel signal includes the encoded bitstream of the stereo signal. Finally, a channel encoder performs channel encoding on the encoded bitstream to obtain a final signal (where the signal may be transmitted to a terminal device or another network device).

Similarly, as shown in FIG. 22, if a codec format of a signal received by a network device is the same as a codec format corresponding to a multichannel decoder, after a channel decoder of the network device performs channel decoding to obtain an encoded bitstream of a multichannel signal, the multichannel decoder may decode the encoded bitstream of the multichannel signal to obtain the multichannel signal. A stereo decoder in the multichannel decoder performs stereo decoding on an encoded bitstream of a stereo signal in the encoded bitstream of the multichannel signal. Next, another multichannel encoder encodes the multichannel signal based on another codec format, to obtain an encoded bitstream of a multichannel signal corresponding to another multichannel encoder. Finally, a channel encoder performs channel encoding on the encoded bitstream corresponding to the another multichannel encoder, to obtain a final signal (where the signal may be transmitted to a terminal device or another network device).

It should be understood that, the another stereo decoder and the multichannel encoder in FIG. 21 are corresponding to different codec formats, and the multichannel decoder and the another stereo encoder in FIG. 22 are corresponding to different codec formats. For example, in FIG. 21, if the codec format corresponding to the another stereo decoder is a first codec format, and the codec format corresponding to the multichannel encoder is a second codec format, converting an audio signal from the first codec format to the second codec format is implemented by the network device. Similarly, in FIG. 22, assuming that the codec format corresponding to the multichannel decoder is a second codec format, and the codec format corresponding to the another stereo encoder is a first codec format, converting an audio signal from the second codec format to the first codec format is implemented by the network device. Therefore, transcoding of a codec format of an audio signal is implemented through processing performed by the another stereo decoder and the multichannel encoder or performed by the multichannel decoder and the another stereo encoder.

It should be further understood that the stereo encoder in FIG. 21 can implement the stereo signal encoding method in the embodiments of this application, and the stereo decoder in FIG. 22 can implement the stereo signal decoding method in the embodiments of this application. The encoding apparatus in the embodiments of this application may be the stereo encoder in the network device in FIG. 21. The decoding apparatus in the embodiments of this application may be the stereo decoder in the network device in FIG. 22. In addition, the network devices in FIG. 21 and FIG. 22 may be specifically wireless network communications devices or wired network communications devices.

This application further provides a chip. The chip includes a processor and a communications interface. The communications interface is configured to communicate with an external component, and the processor is configured to perform the method for reconstructing a signal during stereo signal coding in the embodiments of this application.

Optionally, in an implementation, the chip may further include a memory. The memory stores an instruction, and the processor is configured to execute the instruction stored in the memory. When the instruction is executed, the processor is configured to perform the method for reconstructing a signal during stereo signal coding in the embodiments of this application.

Optionally, in an implementation, the chip is integrated into a terminal device or a network device.

This application provides a chip. The chip includes a processor and a communications interface. The communications interface is configured to communicate with an external component, and the processor is configured to perform the method for reconstructing a signal during stereo signal coding in the embodiments of this application.

Optionally, in an implementation, the chip may further include a memory. The memory stores an instruction, and the processor is configured to execute the instruction stored in the memory. When the instruction is executed, the processor is configured to perform the method for reconstructing a signal during stereo signal coding in the embodiments of this application.

Optionally, in an implementation, the chip is integrated into a network device or a terminal device.

This application provides a computer readable storage medium. The computer readable storage medium is configured to store program code executed by a device, and the program code includes an instruction used to perform the method for reconstructing a signal during stereo signal coding in the embodiments of this application.

This application provides a computer readable storage medium. The computer readable storage medium is configured to store program code executed by a device, and the program code includes an instruction used to perform the method for reconstructing a signal during stereo signal coding in the embodiments of this application.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of this application.

It may be clearly understood by a person skilled in the art that, for the purpose of convenient and brief description, for a detailed working process of the foregoing system, apparatus, and unit, refer to a corresponding process in the foregoing method embodiments, and details are not described herein again.

In the several embodiments provided in this application, it should be understood that the disclosed systems, apparatuses, and methods may be implemented in other manners. For example, the described apparatus embodiments are merely examples. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected based on actual requirements to achieve the objectives of the solutions of the embodiments.

In addition, functional units in the embodiments of this application may be integrated into one processing unit, or each of the units may exist alone physically, or two or more units are integrated into one unit.

When the functions are implemented in the form of a software functional unit and sold or used as an independent product, the functions may be stored in a computer readable storage medium. Based on such an understanding, the technical solutions of this application essentially, or the part contributing to the prior art, or some of the technical solutions may be implemented in a form of a software product. The computer software product is stored in a storage medium, and includes several instructions for instructing a computer device (which may be a personal computer, a server, a network device, or the like) to perform all or some of the steps of the methods described in the embodiments of this application. The foregoing storage medium includes any medium that can store program code, such as a USB flash drive, a removable hard disk, a read-only memory (ROM), a random access memory (RAM), a magnetic disk, or an optical disc.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. A method for reconstructing a signal during stereo signal encoding, comprising:

obtaining a reference sound channel and a target sound channel in a current frame;

obtaining an adaptive length of a transition segment in the current frame based on an inter-channel time difference in the current frame and an initial length of the transition segment in the current frame;

obtaining a transition window in the current frame based on the adaptive length of the transition segment in the current frame;

obtaining a gain modification factor of a reconstructed signal in the current frame; and obtaining a transition segment signal on the target sound channel in the current frame based on the inter-channel time difference in the current frame, the adaptive length of the transition segment in the current frame, the transition window in the current frame, the gain modification factor in the current frame, a reference sound channel signal in the current frame, and a target sound channel signal in the current frame.

2. The method according to claim 1, wherein the obtaining an adaptive length of a transition segment in the current frame based on an inter-channel time difference in the current frame and an initial length of the transition segment in the current frame comprises:

obtaining the initial length of the transition segment in the current frame as the adaptive length of the transition segment in the current frame when an absolute value of the inter-channel time difference in the current frame is greater than or equal to the initial length of the transition segment in the current frame; or obtaining the absolute value of the inter-channel time difference in the current frame as the adaptive length of the transition segment when an absolute value of the inter-channel time difference in the current frame is less than the initial length of the transition segment in the current frame.

3. The method according to claim 1, wherein the transition segment signal on the target sound channel in the current frame satisfies the following formula:

$$\text{transition_seg}(i)=w(i)*g*\text{reference}(N-\text{adp_Ts}-\text{abs}(\text{cur_itd})+i)+(1-w(i))*\text{target}(N-\text{adp_Ts}+i),$$

wherein:

i=0, 1, . . . , adp_Ts−1;

transition_seg(i) represents the transition segment signal on the target sound channel in the current frame;

adp_Ts represents the adaptive length of the transition segment in the current frame;

w(i) represents the transition window in the current frame;

g represents the gain modification factor in the current frame;

target(N−adp_Ts+i) represents the target sound channel signal in the current frame;

reference(N−adp_Ts−abs(cur_itd)+i) represents the reference sound channel signal in the current frame;

cur_itd represents the inter-channel time difference in the current frame;

abs(cur_itd) represents the absolute value of the inter-channel time difference in the current frame; and N represents a frame length of the current frame.

4. The method according to claim 1, wherein the obtaining a gain modification factor of a reconstructed signal in the current frame comprises:

obtaining an initial gain modification factor based on the transition window in the current frame, the adaptive length of the transition segment in the current frame, the target sound channel signal in the current frame, the reference sound channel signal in the current frame, and the inter-channel time difference in the current frame, wherein the initial gain modification factor is the gain modification factor in the current frame; or obtaining an initial gain modification factor based on the transition window in the current frame, the adaptive length of the transition segment in the current frame, the target sound channel signal in the current frame, the reference sound channel signal in the current frame, and the inter-channel time difference in the current frame; and modifying the initial gain modification factor based on a first modification coefficient to obtain the gain modification factor in the current frame, wherein the first modification coefficient is a preset real number greater than 0 and less than 1; or obtaining an initial gain modification factor based on the inter-channel time difference in the current frame, the target sound channel signal in the current frame, and the reference sound channel signal in the current frame; and modifying the initial gain modification factor based on a second modification coefficient to obtain the gain modification factor in the current frame, wherein the second modification coefficient is a preset real number greater than 0 and less than 1, or wherein the second modification coefficient is obtained according to a preset algorithm.

5. The method according to claim 4, wherein the initial gain modification factor satisfies the following formula:

$$g=\frac{-b+\sqrt{b^2-4ac}}{2a},$$

wherein:

$$a=\frac{1}{N-T_0}\sum_{i=T_d}^{N-1}y^2(i)+\left[\sum_{i=T_s}^{T_d-1}w(i-T_s)\cdot y(i)\right]^2;$$

$$b=\frac{2}{N-T_0}\sum_{i=T_s}^{T_d-1}[1-w(i-T_s)]\cdot x(i+\text{abs}(\text{cur_itd}))\cdot w(i-T_s)\cdot y(i);\text{ and}$$

$$c=\frac{1}{N-T_0}\left[\sum_{i=T_0}^{T_s-1}x^2(i+\text{abs}(\text{cur_itd}))+\sum_{i=T_s}^{T_d-1}[[1-w(i-T_s)]x(i+\text{abs}(\text{cur_itd}))]^2\right]-\frac{K}{T_d-T_0}\sum_{i=T_0}^{T_d-1}x^2(i),$$

and wherein:

K represents an energy attenuation coefficient, K is a preset real number, and $0<K\leq 1$;

g represents the gain modification factor in the current frame;

$w(i-T_s)$ represents the transition window in the current frame;

x(i+abs(cur_itd)) represents the target sound channel signal in the current frame;

y(i) represents the reference sound channel signal in the current frame;

N represents the frame length of the current frame;

$T_s$ represents a sampling point index that is of the target sound channel and that corresponds to a start sampling point index of the transition window;

$T_d$ represents a sampling point index that is of the target sound channel and that corresponds to an end sampling point index of the transition window;

$T_s$=N−abs(cur_itd)−adp_Ts, and $T_d$=N−abs(cur_itd);

$T_0$ represents a preset start sampling point index that is of the target sound channel and that is used to calculate the gain modification factor, and $0\leq T_0<T_s$;

cur_itd represents the inter-channel time difference in the current frame;

abs(cur_itd) represents the absolute value of the inter-channel time difference in the current frame; and adp_Ts represents the adaptive length of the transition segment in the current frame.

6. The method according to claim 4, wherein the method further comprises:

obtaining a forward signal on the target sound channel in the current frame based on the inter-channel time difference in the current frame, the gain modification factor in the current frame, and the reference sound channel signal in the current frame.

7. The method according to claim 6, wherein the forward signal on the target sound channel in the current frame satisfies the following formula:

$$\text{reconstruction_seg}(i)=g*\text{reference}(N-\text{abs}(\text{cur_itd})+i),$$

wherein:

i=0, 1, . . . , abs(cur_itd)−1;

reconstruction_seg(i) represents the forward signal on the target sound channel in the current frame;

g represents the gain modification factor in the current frame;

reference(N−abs(cur_itd)+i) represents the reference sound channel signal in the current frame;

cur_itd represents the inter-channel time difference in the current frame;

abs(cur_itd) represents the absolute value of the inter-channel time difference in the current frame; and N represents the frame length of the current frame.

8. The method according to claim 4, wherein when the second modification coefficient is obtained according to the preset algorithm, the second modification coefficient is obtained based on the reference sound channel signal and the target sound channel signal in the current frame, the inter-channel time difference in the current frame, the adaptive length of the transition segment in the current frame, the transition window in the current frame, and the gain modification factor in the current frame.

9. The method according to claim 8, wherein the second modification coefficient satisfies the following formula:

$$\text{adj_fac} = \frac{\frac{K}{T_d - T_0}\sum_{i=T_0}^{T_d-1} x^2(i)}{\frac{1}{N - T_s}\left[\sum_{i=T_s}^{T_d-1}\left[\begin{array}{c}[1 - w(i - T_s)]\cdot x(i + \text{abs(cur_itd)}) + \\ w(i - T_s)\cdot g\cdot y(i)\end{array}\right]^2 + \sum_{i=T_d}^{N-1} g^2\cdot y^2(i)\right]},$$

wherein:

adj_fac represents the second modification coefficient;

K represents the energy attenuation coefficient, K is the preset real number, and $0<K\leq 1$;

g represents the gain modification factor in the current frame;

$w(i-T_s)$ represents the transition window in the current frame;

x(i+abs(cur_itd)) represents the target sound channel signal in the current frame;

y(i) represents the reference sound channel signal in the current frame;

N represents the frame length of the current frame;

$T_s$ represents the sampling point index that is of the target sound channel and that corresponds to the start sampling point index of the transition window;

$T_d$ represents the sampling point index that is of the target sound channel and that corresponds to the end sampling point index of the transition window;

$T_s$=N−abs(cur_itd)−adp_Ts, and $T_d$=N−abs(cur_itd);

$T_0$ represents the preset start sampling point index that is of the target sound channel and that is used to calculate the gain modification factor, and $0\leq T_0<T_s$;

cur_itd represents the inter-channel time difference in the current frame;

abs(cur_itd) represents the absolute value of the inter-channel time difference in the current frame; and adp_Ts represents the adaptive length of the transition segment in the current frame.

10. The method according to claim 8, wherein the second modification coefficient satisfies the following formula:

$$\text{adj_fac} = \frac{\frac{K}{T_d - T_0}\sum_{i=T_0}^{T_d-1} x^2(i)}{\frac{1}{N - T_0}\left[\begin{array}{c}\sum_{i=T_0}^{T_s-1} x^2(i + \text{abs(cur_itd)}) + \sum_{i=T_s}^{T_d-1}\left[\begin{array}{c}[1 - w(i - T_s)]\cdot x(i + \text{abs(cur_itd)}) + \\ w(i - T_s)\cdot g\cdot y(i)\end{array}\right]^2 + \\ \sum_{i=T_d}^{N-1} g^2\cdot y^2(i)\end{array}\right]},$$

wherein:

adj_fac represents the second modification coefficient;

K represents the energy attenuation coefficient, K is the preset real number, and $0<K\leq 1$;

g represents the gain modification factor in the current frame;

$w(i-T_s)$ represents the transition window in the current frame;

x(i+abs(cur_itd)) represents the target sound channel signal in the current frame;

y(i) represents the reference sound channel signal in the current frame;

N represents the frame length of the current frame;

$T_s$ represents the sampling point index that is of the target sound channel and that corresponds to the start sampling point index of the transition window, $T_d$ represents the sampling point index that is of the target sound channel and that corresponds to the end sampling point index of the transition window, $T_s$=N−abs(cur_itd)−adp_Ts, and $T_d$=N−abs(cur_itd);

$T_0$ represents the preset start sampling point index that is of the target sound channel and that is used to calculate the gain modification factor, and $0\leq T_0<T_s$;

cur_itd represents the inter-channel time difference in the current frame;

abs(cur_itd) represents the absolute value of the inter-channel time difference in the current frame; and adp_Ts represents the adaptive length of the transition segment in the current frame.

11. An apparatus for reconstructing a signal during stereo signal encoding, comprising:

a non-transitory memory for storing computer-executable instructions; and at least one processor operatively coupled to the non-transitory memory, wherein the computer-executable instructions instruct the at least one processor to:

obtain a reference sound channel and a target sound channel in a current frame;

obtain an adaptive length of a transition segment in the current frame based on an inter-channel time difference in the current frame and an initial length of the transition segment in the current frame;

obtain a transition window in the current frame based on the adaptive length of the transition segment in the current frame;

obtain a gain modification factor of a reconstructed signal in the current frame; and obtain a transition segment signal on the target sound channel in the current frame based on the inter-channel time difference in the current frame, the adaptive length of the transition segment in the current frame, the transition window in the current frame, the gain modification factor in the current frame, a reference sound channel signal in the current frame, and a target sound channel signal in the current frame.

12. The apparatus according to claim 11, wherein the computer-executable instructions instruct the at least one processor to:

obtain the initial length of the transition segment in the current frame as the adaptive length of the transition segment in the current frame when an absolute value of the inter-channel time difference in the current frame is greater than or equal to the initial length of the transition segment in the current frame; or obtain the absolute value of the inter-channel time difference in the current frame as the adaptive length of the transition segment when an absolute value of the inter-channel time difference in the current frame is less than the initial length of the transition segment in the current frame.

13. The apparatus according to claim 11, wherein the transition segment signal that is on the target sound channel in the current frame satisfies the following formula:

$$\text{transition_seg}(i)=w(i)*g*\text{reference}(N-\text{adp_Ts}-\text{abs}(\text{cur_itd})+i)+(1-w(i))*\text{target}(N-\text{adp_Ts}+i),$$

wherein:

i=0, 1, . . . , adp_Ts−1;

transition_seg(i) represents the transition segment signal on the target sound channel in the current frame;

adp_Ts represents the adaptive length of the transition segment in the current frame;

w(i) represents the transition window in the current frame;

g represents the gain modification factor in the current frame;

target(N−adp_Ts+i) represents the target sound channel signal in the current frame;

reference(N−adp_Ts−abs(cur_itd)+i) represents the reference sound channel signal in the current frame;

cur_itd represents the inter-channel time difference in the current frame;

abs(cur_itd) represents the absolute value of the inter-channel time difference in the current frame; and N represents a frame length of the current frame.

14. The apparatus according to claim 11, wherein the computer-executable instructions instruct the at least one processor to:

obtain an initial gain modification factor based on the transition window in the current frame, the adaptive length of the transition segment in the current frame, the target sound channel signal in the current frame, the reference sound channel signal in the current frame, and the inter-channel time difference in the current frame; or obtain an initial gain modification factor based on the transition window in the current frame, the adaptive length of the transition segment in the current frame, the target sound channel signal in the current frame, the reference sound channel signal in the current frame, and the inter-channel time difference in the current frame; and modify the initial gain modification factor based on a first modification coefficient to obtain the gain modification factor in the current frame, wherein the first modification coefficient is a preset real number greater than 0 and less than 1; or obtain an initial gain modification factor based on the inter-channel time difference in the current frame, the target sound channel signal in the current frame, and the reference sound channel signal in the current frame; and modify the initial gain modification factor based on a second modification coefficient to obtain the gain modification factor in the current frame, wherein the second modification coefficient is a preset real number greater than 0 and less than 1, or wherein the second modification coefficient is determined according to a preset algorithm.

15. The apparatus according to claim 14, wherein the initial gain modification factor satisfies the following formula:

$$g=\frac{-b+\sqrt{b^2-4ac}}{2a},$$

wherein:

$$a=\frac{1}{N-T_0}\sum_{i=T_d}^{N-1}y^2(i)+\left[\sum_{i=T_s}^{T_d-1}w(i-T_s)\cdot y(i)\right]^2;$$

$$b=\frac{2}{N-T_0}\sum_{i=T_s}^{T_d-1}[1-w(i-T_s)]\cdot x(i+\text{abs}(\text{cur_itd}))\cdot w(i-T_s)\cdot y(i);\text{ and}$$

$$c=\frac{1}{N-T_0}\left[\sum_{i=T_0}^{T_s-1}x^2(i+\text{abs}(\text{cur_itd}))+\sum_{i=T_s}^{T_d-1}[[1-w(i-T_s)]x(i+\text{abs}(\text{cur_itd}))]^2\right]-\frac{K}{T_d-T_0}\sum_{i=T_0}^{T_d-1}x^2(i),$$

wherein:

K represents an energy attenuation coefficient, K is a preset real number, and $0<K\leq 1$;

g represents the gain modification factor in the current frame;

$w(i-T_s$ represents the transition window in the current frame;

x(i+abs(cur_itd)) represents the target sound channel signal in the current frame;

y(i) represents the reference sound channel signal in the current frame;

N represents the frame length of the current frame;

$T_s$ represents a sampling point index that is of the target sound channel and that corresponds to a start sampling point index of the transition window;

$T_d$ represents a sampling point index that is of the target sound channel and that corresponds to an end sampling point index of the transition window;

$T_s$=N−abs(cur_itd)−adp_Ts, and $T_d$=N−abs(cur_itd);

$T_0$ represents a preset start sampling point index that is of the target sound channel and that is used to calculate the gain modification factor, and $0\leq T_0<T_s$;

cur_itd represents the inter-channel time difference in the current frame;

abs(cur_itd) represents the absolute value of the inter-channel time difference in the current frame; and adp_Ts represents the adaptive length of the transition segment in the current frame.

16. The apparatus according to claim 14, wherein the computer-executable instructions instruct the at least one processor to:

obtain a forward signal on the target sound channel in the current frame based on the inter-channel time difference in the current frame, the gain modification factor in the current frame, and the reference sound channel signal in the current frame.

17. The apparatus according to claim 16, wherein the forward signal that is on the target sound channel in the current frame satisfies the following formula:

$$\text{reconstruction_seg}(i)=g*\text{reference}(N-\text{abs}(\text{cur_itd})+i),$$

wherein:

i=0, 1, . . . , abs(cur_itd)−1;

reconstruction_seg(i) represents the forward signal on the target sound channel in the current frame;

g represents the gain modification factor in the current frame;

reference(N−abs(cur_itd)+i) represents the reference sound channel signal in the current frame;

cur_itd represents the inter-channel time difference in the current frame;

abs(cur_itd) represents the absolute value of the inter-channel time difference in the current frame; and N represents the frame length of the current frame.

18. The apparatus according to claim 14, wherein when the second modification coefficient is determined according to the preset algorithm, the second modification coefficient is determined based on the reference sound channel signal and the target sound channel signal in the current frame, the inter-channel time difference in the current frame, the adaptive length of the transition segment in the current frame, the transition window in the current frame, and the gain modification factor in the current frame.

19. The apparatus according to claim 18, wherein the second modification coefficient satisfies the following formula:

$$\text{adj_fac}=\frac{\frac{K}{T_d-T_0}\sum_{i=T_0}^{T_d-1}x^2(i)}{\frac{1}{N-T_s}\left[\sum_{i=T_s}^{T_d-1}\left[\begin{matrix}[1-w(i-T_s)]\cdot x(i+\text{abs}(\text{cur_itd}))+\\ w(i-T_s)\cdot g\cdot y(i)\end{matrix}\right]^2+\sum_{i=T_d}^{N-1}g^2\cdot y^2(i)\right]},$$

wherein:

adj_fac represents the second modification coefficient;

K represents the energy attenuation coefficient, K is the preset real number, 0<K≤1;

g represents the gain modification factor in the current frame;

w(i−Ts) represents the transition window in the current frame;

x(i+abs(cur_itd)) represents the target sound channel signal in the current frame;

y(i) represents the reference sound channel signal in the current frame;

N represents the frame length of the current frame;

$T_s$ represents the sampling point index that is of the target sound channel and that corresponds to the start sampling point index of the transition window;

$T_d$ represents the sampling point index that is of the target sound channel and that corresponds to the end sampling point index of the transition window;

$T_s$=N−abs(cur_itd)−adp_Ts, and $T_d$=N−abs(cur_itd);

$T_0$ represents the preset start sampling point index that is of the target sound channel and that is used to calculate the gain modification factor, and $0\le T_0<T_s$;

cur_itd represents the inter-channel time difference in the current frame;

abs(cur_itd) represents the absolute value of the inter-channel time difference in the current frame; and adp_Ts represents the adaptive length of the transition segment in the current frame.

20. The apparatus according to claim 18, wherein the second modification coefficient satisfies the following formula:

$$\text{adj_fac}=\frac{\frac{K}{T_d-T_0}\sum_{i=T_0}^{T_d-1}x^2(i)}{\frac{1}{N-T_0}\left[\begin{matrix}\sum_{i=T_0}^{T_s-1}x^2(i+\text{abs}(\text{cur_itd}))+\sum_{i=T_s}^{T_d-1}\\ \left[\begin{matrix}[1-w(i-T_s)]\cdot x(i+\text{abs}(\text{cur_itd}))+\\ w(i-T_s)\cdot g\cdot y(i)\end{matrix}\right]^2+\\ \sum_{i=T_d}^{N-1}g^2\cdot y^2(i)\end{matrix}\right]},$$

wherein:

adj_fac represents the second modification coefficient;

K represents the energy attenuation coefficient, K is the preset real number, 0<K≤1;

g represents the gain modification factor in the current frame;

w(i−Ts) represents the transition window in the current frame;

x(i+abs(cur_itd)) represents the target sound channel signal in the current frame;

y(i) represents the reference sound channel signal in the current frame;

N represents the frame length of the current frame;

$T_s$ represents the sampling point index that is of the target sound channel and that corresponds to the start sampling point index of the transition window;

$T_d$ represents the sampling point index that is of the target sound channel and that corresponds to the end sampling point index of the transition window;

$T_s$=N−abs(cur_itd)−adp_Ts, and $T_d$=N−abs(cur_itd);

$T_0$ represents the preset start sampling point index that is of the target sound channel and that is used to calculate the gain modification factor, and $0\le T_0<T_s$;

cur_itd represents the inter-channel time difference in the current frame;

abs(cur_itd) represents the absolute value of the inter-channel time difference in the current frame; and adp_Ts represents the adaptive length of the transition segment in the current frame.

* * * * *